US008967075B2

(12) United States Patent
Miyamoto et al.

(10) Patent No.: US 8,967,075 B2
(45) Date of Patent: Mar. 3, 2015

(54) INKJET COATING DEVICE AND INKJET COATING METHOD

(75) Inventors: Yoshitsugu Miyamoto, Ryugasaki (JP); Toshiharu Kishimura, Ryugasaki (JP); Hitoshi Manabe, Ushiko (JP); Katsuyoshi Watanabe, Kudamatsu (JP); Naoki Watase, Kashiwa (JP); Hideo Nakamura, Ushiku (JP)

(73) Assignee: Hitachi, Ltd., Tokyo (JP)

( * ) Notice: Subject to any disclaimer, the term of this patent is extended or adjusted under 35 U.S.C. 154(b) by 734 days.

(21) Appl. No.: 12/914,031

(22) Filed: Oct. 28, 2010

(65) Prior Publication Data

US 2011/0104391 A1 May 5, 2011

(30) Foreign Application Priority Data

Oct. 29, 2009 (JP) ..... 2009-248905
Mar. 29, 2010 (JP) ..... 2010-075636

(51) Int. Cl.
*B05C 5/02* (2006.01)
*B41J 11/00* (2006.01)
(Continued)

(52) U.S. Cl.
CPC ..... *B41J 11/0015* (2013.01); *B05C 5/02* (2013.01); *B05C 5/027* (2013.01); *B41J 11/0005* (2013.01); *B41J 11/0085* (2013.01); *B41J 11/06* (2013.01); *B41M 5/0011* (2013.01)
USPC ..... 118/300; 118/641; 118/323; 118/325

(58) Field of Classification Search
CPC ..... B41J 11/0005; B41J 11/0015; B41J 11/0085; B41J 11/06; B41M 5/0011; B05C 5/02; B05C 5/027
USPC ..... 347/102, 1, 2, 4, 30; 118/641, 300, 325, 118/323
See application file for complete search history.

(56) References Cited

U.S. PATENT DOCUMENTS 6,783,227 B2 * 8/2004 Suzuki et al. ..... 347/102
2005/0174412 A1 * 8/2005 Codos et al. ..... 347/102
(Continued)

FOREIGN PATENT DOCUMENTS

JP 09-239968 9/1997
(Continued)

OTHER PUBLICATIONS

Official Action mailed Nov. 26, 2013 in connection with Japanese Application No. 2010-075636.

*Primary Examiner* — Laura Edwards
(74) *Attorney, Agent, or Firm* — Antonelli, Terry, Stout & Kraus, LLP.

(57) ABSTRACT

When the coating object area is positioned on the suction table, the film is stopped and is mounted on the suction table, and is further provided with tension in the longitudinal direction to eliminate slacks or the like, but, curl is caused in the both side end regions in the coating object area. Therefore, the coating object area is mounted on the suction table, and at the same time, the curl correction bars disposed on the both sides of the suction table are moved to the curled portions of the coating object area, and then the curled portions are pressed against the suction surface of the suction table to thereby perform the curl correction. Further, in the coating process with the UV-curing coating material, the UV light from the UV light source formed integrally with the coating head is applied to cure the material. In the vacuum suction section, as the destination, the bubbles or the like in the coating head are sucked. When the suction of the coating head is not performed, the UV shutter is moved by the suction section air cylinder to block the suction port of the vacuum suction section. Thus, the inside of the vacuum suction section is shielded from the UV light.

8 Claims, 14 Drawing Sheets

(51) Int. Cl.

| | |
|---|---|
| ***B41J 11/06*** | (2006.01) |
| *B41M 5/00* | (2006.01) |

(56) References Cited

U.S. PATENT DOCUMENTS

| | | | | |
|---|---|---|---|---|
| 2008/0137047 | A1* | 6/2008 | Mizutani et al. | 355/30 |
| 2008/0186352 | A1* | 8/2008 | Sasayama | 347/30 |

FOREIGN PATENT DOCUMENTS

| | | |
|---|---|---|
| JP | 2004-314304 | 11/2004 |
| JP | 2004-314478 | 11/2004 |
| JP | 2005-212319 | 8/2005 |
| JP | 2008-272996 | 11/2008 |
| JP | 2010-36184 | 2/2010 |
| WO | WO 02/078958 | 10/2002 |

* cited by examiner

S120

S130

S140

S150

S150

S150
1
10
13
14
19

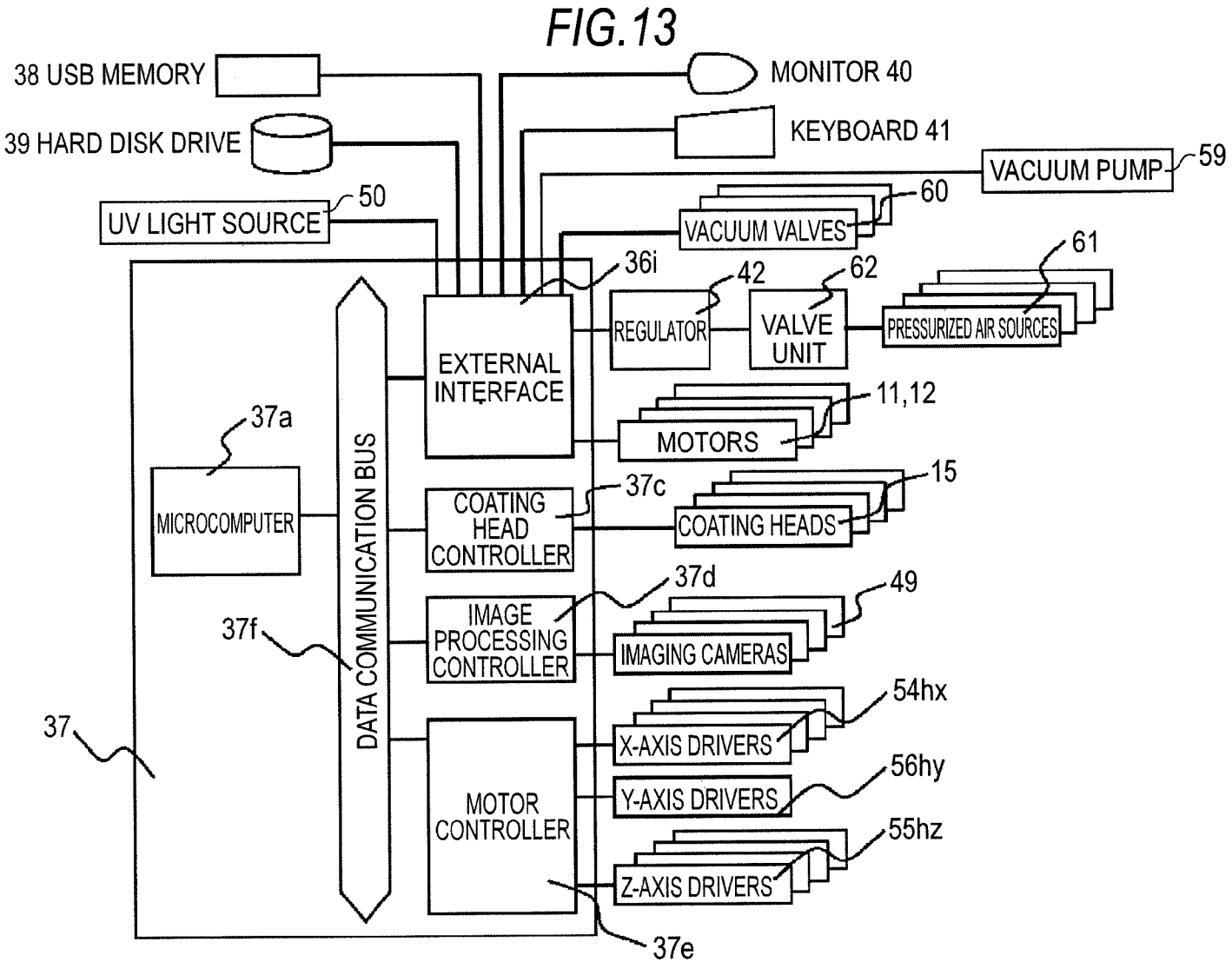
FIG.13
MONITOR 40
KEYBOARD 41
VACUUM PUMP
59
60
VACUUM VALVES
61
PRESSURIZED AIR SOURCES
62
VALVE UNIT
42
REGULATOR
11,12
MOTORS
15
COATING HEADS
49
IMAGING CAMERAS
54hx
X-AXIS DRIVERS
56hy
Y-AXIS DRIVERS
55hz
Z-AXIS DRIVERS
36i
EXTERNAL INTERFACE
37c
COATING HEAD CONTROLLER
37d
IMAGE PROCESSING CONTROLLER
MOTOR CONTROLLER
37e
DATA COMMUNICATION BUS
37f
37a
MICROCOMPUTER
50
UV LIGHT SOURCE
38 USB MEMORY
39 HARD DISK DRIVE
37

INKJET COATING DEVICE AND INKJET COATING METHOD

BACKGROUND OF THE INVENTION

The present invention relates to a roll-to-roll inkjet coating device and a roll-to-roll inkjet coating method used for manufacturing a flexible material using inkjet coating.

Further, the invention relates to an inkjet coating device and an inkjet coating method for stably performing coating of a material having an ultraviolet curing function (hereinafter also referred to as UV curing function).

An inkjet method denotes a method of ejecting ink droplets of a small amount with high accuracy from an inkjet coating head using bubbles or a piezoelectric element.

In the past, as an example of a printing device, there is disclosed in JP-A-9-239968 a printing device provided with an introducing section for introducing a print medium while performing an anti-wrinkle process and an alignment process in the width direction on the print medium, a conveying section disposed adjacent to the introducing section so as to be opposed to the print medium and for conveying the print medium with a belt, a print section disposed so as to be opposed to the print medium and having a plurality of lines of line heads corresponding to the number of kinds of colors, and a drying section disposed on the downstream of the print section in a direction in which the print medium is conveyed in the print section, and for drying the print medium after printing.

In such a printing device, the anti-wrinkle process, a process of centering with respect to the center along the conveying direction, a texture correction process, and a process of correcting curl on both edges (both selvages of a fabric) are performed on a sheet-like print medium (e.g., a fabric roll or fabric housed in a box) using a plurality of rollers.

Further, regarding a nozzle vacuum suction section, there is disclosed in JP-A-2008-272996 a technology of creating the condition in which ink can be ejected stably by covering a coating head, and setting the inside of the coating head to appropriate negative pressure by a suction section to thereby remove bubbles inside the coating head.

As support to the ink liquid types (an ink liquid of a UV-curing coating material; hereinafter referred to as a UV-curing coating material) there can be cited a technology for preventing the ink liquid from being cured before landing and rapidly curing the ink liquid after landing. In order to realize the technology, there is disclosed in JP-A-2004-314304 a technology provided with coating heads attached to a carriage moving in a main scanning direction, UV light sources, and covers covering the respective UV light sources.

A side surface of the cover extends downward beyond a lower surface of the coating head, and is disposed between the coating head and the UV light source. A lower end of the side surface of the cover is provided with a flange extending toward a course of a droplet.

According to such a configuration, ultraviolet light from the UV light source is shielded by the side surface of the cover, and thus, the ultraviolet light is prevented from reaching the coating head and the course of the ink droplet of the UV-curing coating material ejected from the coating head. Further, the ultraviolet light reflected by a recording medium is shielded by the flange, and the ultraviolet light thus reflected is prevented from reaching the head and the course of the droplet.

A film unrolled and then conveyed in the roll-to-roll process includes both of a region with a semiconductor material deposited on the surface of the film and a region without the semiconductor material. Therefore, both side end regions in the width direction of the film become in a curled state. When holding the film, thus wound off from the roll as described above, for coating with a coating material by sucking using a suction table, if the curl exists in the both side end regions, it becomes difficult for the film to be sucked evenly on the suction table. Therefore, there arises a problem that wrinkles or slacks is caused. As described above, if the wrinkles or the slacks is caused, a nozzle tip surface of an inkjet head or the like for coating has contact with the film, and the nozzle surface might be damaged.

Further, in the coating process of the related art using the UV-curing coating material, there have been cited the following three stages as the states for considering whether or not the curing is allowed. Specifically, there have been sited the stage before ejection in which the material is stored in the coating head, the stage (the stage corresponding to the movement along the "course of a droplet" in JP-A-2008-272996) in the process of ejection in which the material has been ejected from the coating head but not yet arrived at an object substrate, and the stage in which the ejected UV-curing coating material has been arrived at the object substrate. In the former two stages, it is preferable that the UV-curing coating material is not cured, while in the last stage in which the droplet of the UV-curing coating material has arrived at the substrate, it is preferable that the material is cured at once.

However, the situation in which it is desired that the UV-curing coating material is not cured is not limited to the case in which the material is stored in the coating head or the case in which the material is in the process of ejection from the coating head. Although the inside of the coating head is filled with the UV-curing coating material, by continuously repeating the coating process, there arises a problem that bubbles are incorporated into the inside of the coating head gradually as time advances.

SUMMARY OF THE INVENTION

An object of the invention is to provide an inkjet coating device and an inkjet coating method capable of performing coating of the film with a coating material in a condition in which the curl of the film in the both side end regions is corrected, thereby making it possible to improve the coating quality of the film.

Further, an other object of the invention is to provide an inkjet coating device and an inkjet coating method capable of surely ejecting the UV-curing coating material from nozzle holes of the inkjet coating head to perform coating without degrading the coating processing time, thereby making it possible to improve the quality of coating the coating object.

In order to achieve the object described above, according to an aspect of the invention there is provided an inkjet coating device including an upstream guide roller adapted to wind off and then convey a rolled film, a suction table adapted to hold by sucking the film thus wound off, a coating head adapted to apply a liquid coating material to a surface of the film thus held by sucking on the suction table, a downstream guide roller adapted to convey the film provided with the coating material and then wind up the film to form a roll, and a pair of curl correction bars adapted to press both side end regions of a coating object area of the film, which is mounted on a suction surface of the suction table, against the suction surface of the suction table, and then uncurl the both side end regions toward side ends of the suction table, wherein curled portions caused in the both side end regions of the coating object area of the film are corrected with the curl correction bars, and the entire coating object area is flattened, and is evenly held by sucking on the suction surface of the suction table.

Further, the suction surface of the suction table being sectioned with respect to a direction perpendicular to a conveying direction of the film into a central area, and peripheral areas on both sides of the central area, there is further provided a control section adapted to control an operation of vacuum suction holes in the central area and an operation of vacuum suction holes in the peripheral areas, wherein under control of the control section, the operation of the vacuum suction holes in the central area is started in response to mounting of the coating object area of the film on the suction table to thereby hold by vacuum sucking an area in the coating object area opposed to the central area, and the operation of the vacuum suction holes in the peripheral areas is started in response to the correction of the curl by the curl correction bars in the both side end regions in the coating object area of the film mounted on the suction table to thereby hold by vacuum sucking areas in the coating object area opposed to the peripheral areas.

Further, there is provided a section adapted to detect uplift of the film vacuum sucked by the suction table from the suction surface of the suction table.

Further, there is provided a section adapted to control air pressure of an elevating cylinder adapted to drive an elevating operation of the curl correction bars, thereby controlling force of uncurling the both side end regions in the coating object area of the film toward the both side ends of the suction table by the curl correction bars.

Further, according to another aspect of the invention, there is provided an inkjet coating method including the steps of (a) winding off and then conveying a film wound to form a roll by an upstream guide roller, (b) mounting a coating object area of the film wound off on a suction surface of the suction table, (c) coating the coating object area with a liquid coating material using a coating head, (d) conveying the film provided with the coating material by a downstream guide roller and then winding up the film to form a roll, and (e) pressing both side end regions in the coating object area of the film mounted on the suction surface of the suction table against the suction surface by curl correction bars, uncurling the both side end regions toward side ends of the suction table, and holding by sucking the both side end regions to the suction surface.

Further, according to still another aspect of the invention, there is provided an inkjet coating device including an upstream guide roller adapted to wind off and then convey a rolled film, a suction table adapted to hold by sucking the film thus wound off, a coating head adapted to apply a liquid UV-curing coating material to a surface of the film thus held by sucking on the suction table, a gantry structure adapted to allow the coating head to move above the film in a plane defined by an X axis and an Y axis, a Z-axis drive section adapted to allow the coating head to move vertically, an ultraviolet light source capable of moving integrally with the coating head in X, Y, and Z axis directions, a vacuum suction section located at a position outside a film conveying range, having a suction port having contact with the coating head when the coating head moves to the position and then moves downward, and adapted to suck nozzles of the coating head through the suction port, and a light blocking section adapted to block incidence of ultraviolet light from the ultraviolet light source to the inside of the vacuum suction section, wherein block of the ultraviolet light and release of the block can be selected in the vacuum suction section.

Further, according to still another aspect of the invention, there is provided an inkjet coating method including the steps of (p) winding off a rolled film and then conveying the film by an upstream guide roller, (q) holding by sucking the film thus wound off with a suction table, (r) applying a liquid UV-curing coating material by a coating head to a surface of the film thus held by sucking on the suction table, (s) allowing the coating head by a gantry structure to move above the film in a plane defined by an X axis and an Y axis, (t) allowing the coating head by a Z-axis drive section to move vertically, (u) providing an ultraviolet light source capable of moving integrally with the coating head in X, Y, and Z axis directions, (v) sucking, by a vacuum suction section located at a position outside a film conveying range, through nozzles of the coating head using a suction port by moving the coating head, which is moved to the position, downward so as to have contact with the suction port, and (w) blocking, by a light blocking section, incidence of the ultraviolet light from the ultraviolet light source to the inside of the vacuum suction section, and selecting, by the light blocking section, one of block of the ultraviolet light and release of the block.

BRIEF DESCRIPTION OF THE DRAWINGS

FIG. 13 is a block diagram showing a configuration of a control section for inkjet coating having a function of UV shield of a vacuum suction section shown in FIG. 10.

DESCRIPTION OF THE PREFERRED EMBODIMENTS

Hereinafter, some embodiments of the invention will be described with reference to the accompanying drawings.

It should be noted that the embodiments explained hereinafter are, as an example, for performing formation of a film such as an electrode or an insulating film on a solar cell film provided with a non-silicon semiconductor material (e.g., CIGS thin film) by applying an electrode material or an insulating material with inkjet coating heads. Among these films, some of the insulating films are applied by filling a coating head with a liquid (a UV-curing coating material) of UV-curing resin as a coating material, and then ejecting the liquid. The UV-curing resin is generally composed of a monomer or an oligomer, a light cure initiator, and an additive agent. When being irradiated with the UV light, due to the photopolymerization reaction, the light cure initiator is transformed from a liquid in a monomer state to a solid in a polymeric state in a short period of time.

It should be noted that the CIGS thin film is a thin film made of a semiconductor material composed of Cu (copper), In (indium), Ga (gallium), and Se (selenium), and the name "CIGS" is obtained by arranging the initial letters of these materials. The thickness of the CIGS thin film can be made as thin as about several tens of micrometers through a hundred micrometers.

Figure 1:
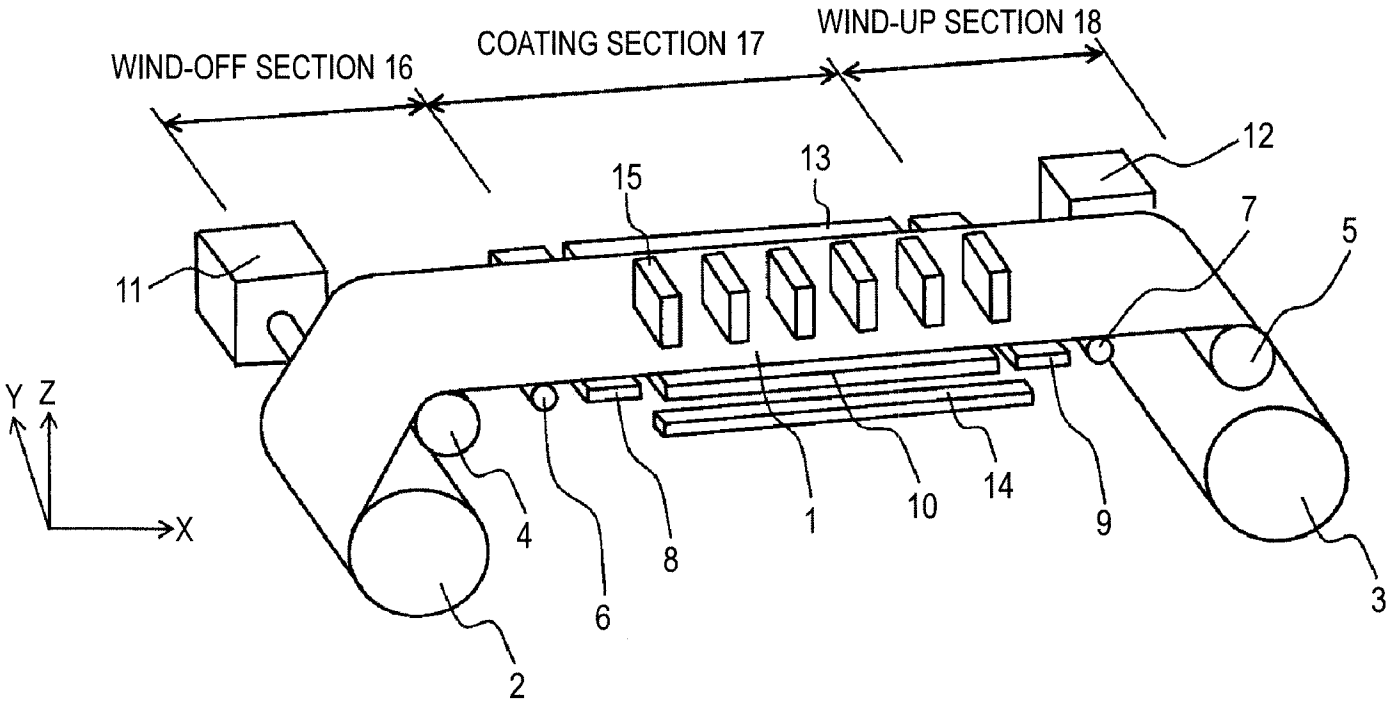
FIG. 1 is a perspective view showing a schematic configuration of an inkjet coating device and an inkjet coating method according to a first embodiment of the invention.

FIG. 1 is a perspective view showing a schematic configuration of the inkjet coating device and the inkjet coating method according to the first embodiment of the invention, wherein the reference numeral 1 denotes a solar cell film (hereinafter simply referred to as a film), the reference numeral 2 denotes a wind-off film roll, the reference numeral 3 denotes a wind-up film roll, the reference numerals 4, 5 denote guide rollers, the reference numerals 6, 7 denote elevating guide rollers, the reference numerals 8, 9 denote suction bars, the reference numeral 10 denotes a suction table, the reference numeral 11 denotes a wind-off spindle motor, the reference numeral 12 denotes a wind-up spindle motor, the reference numerals 13, 14 denote curl correction bars, the reference numeral 15 denotes coating heads, the reference numeral 16 denotes a wind-off section, the reference numeral 17 denotes a coating section, and the reference numeral 18 denotes a wind-up section.

In the drawing, the space is separated in the X-axis direction into the wind-off section 16, the coating section 17, and the wind-up section 19, and the wind-off section 16 includes the wind-off film roll 2 rotationally driven by the wind-off spindle motor 11, the guide roller 4 on the upstream side, the elevating guide roller 6, and the suction bar 8 arranged sequentially in the X-axis direction, the wind-up section 18 is provided with the suction bar 9 on the downstream side, the elevating guide roller 7, the guide roller 5, and the wind-up film roll 3 arranged sequentially in the X-axis direction. Further, the coating section 17 is provided with the suction table 10, the coating heads 15, and the curl correction bars 13, 14.

In the wind-off section 16, the film 1 to be the coating object of the electrode material and the insulating material in the coating section 17 is wound around the wind-off film roll 2 to form a roll. Further, the film 1 is wound off from the wind-off film roll 2, passes through the coating section 17, and then wound up to the wind-up film roll 3 in the wind-up section 18. In this state, the longitudinal direction of the film 1 corresponds to the X-axis direction, and the width direction thereof corresponds to the Y-axis direction. Further, a direction perpendicular to a plane including the X axis and the Y axis corresponds to the Z-axis direction.

In the coating section 17, the film 1 has vacuum contact with the suction table 10 to be positioned, and further, a plurality of inkjet coating heads supported by a gantry (portal frame) structure, not shown, is disposed, thereby applying a liquid electrode material or liquid insulating material (hereinafter collectively referred to as a "coating material") to the surface of the CIGS thin film of the film 1 to form the electrode or the insulating film. The CIGS thin film is provided with a groove-like recessed section, and the coating material is applied to the recessed section to form the electrode or the insulating film.

Further, the coating heads 15 are each allowed to move in a X-Y plane and in a Z-axis direction (the height direction). The lower surface of each of the coating heads 15 is provided with approximately 250 nozzle holes directed to the film 1, and the droplets of the coating material are pushed out by the piezoelectric actuation to be ejected on the film 1. As described above, by the nozzles of the coating heads 15 moving in the X-Y plane and individually emitting the coating material, it becomes possible to finely apply the coating material to the coating surface of the film 1 in any pattern.

In such a manner as described above, when the coating process with the coating material in a predetermined coating object area of the film 1 is completed in the coating section 17, the film 1 is wound off from the wind-off film roll 2. Further, the film 1 is conveyed from the side of the wind-off film roll 2 to the side of the wind-up film roll 3 so that the succeeding coating object area of the film 1 is disposed at a position where the coating process is to be performed by winding up the film 1 to the wind-up film roll 3. Here, in the wind-off section 16, the film 1 wound off from the wind-off film roll 2 rotationally driven by the wind-off spindle motor 11 is supported by the guide roller 4 and the elevating guide roller 6. On this occasion, the elevating guide roller 6 has been raised to a position higher than the suction surface of the suction table 10. Further, in the wind-up section 18, the film 1 is supported by the elevating guide roller 7 and the guide roller 5, and wound up to the wind-up film roll 3, and the elevating guide roller 7 has been raised to a position higher than the suction surface of the suction table 10. Thus, the film 1 moves in the X-axis direction without having contact with the suction bars 8, 9 and the suction table 10.

In such a manner as described above, when the film 1 is transferred from the side of the wind-off section 16 to the side of the wind-up section 18, the film 1 is lifted by the elevating guide rollers 6, 7 so that the film 1 can be conveyed without having contact with the suction table 10, and therefore, scratches can be prevented from being caused on the reverse side of the film 1.

The film 1 is conveyed by the elevating guide rollers 6, 7 in the condition in which the film 1 does not have contact with the suction bars 8, 9 and the suction table 10, and when the succeeding coating object area in the film 1 reaches the coating section 17, the conveyance of the film 1 is terminated. The alignment of the coating object area in the X-axis direction in the coating section 17 is then performed. In this alignment process, firstly, the amount of winding of the wind-up film roll 3 is monitored to thereby perform rough alignment. Subsequently, a mark, not shown, provided to each of the coating object areas of the film 1 is shot with a camera, not shown, and then, the position of the film 1 in the X-axis direction is precisely adjusted by controlling the wind-off spindle motor 11 and the wind-up spindle motor 12 so that the mark is located at a predetermined position of the shot area. After the alignment is finished, the brake is applied to the wind-up spindle motor 12 to make the film 1 in the wind-up section 18 become in the fixed state. Further, simultaneously therewith, the wind-off spindle motor 11 is made to become in the state of applying torque in the reverse rotational direction to the rotational direction for winding off the film 1.

Thus, even after the conveyance of the film 1 is terminated, the film 1 is held in the state in which tension is applied to the film 1 in the longitudinal direction (the X-axis direction along which the film 1 is conveyed) thereof, and therefore, no slack is caused in the film 1.

In this state, in the coating section 17, in the condition in which the elevating guide rollers 6, 7 are raised as described above, both of the suction bars 8, 9 rise to have contact with the reverse side of the film 1 and hold the film 1 by sucking. Subsequently, the elevating guide rollers 6, 7 move downward below the suction surface of the suction table 10, and then the suction bars 8, 9 move downward while holding the film 1 by sucking to make the reverse side of the film 1 have contact with the suction surface of the suction table 10. Thus, the film 1 is held by the suction table 10 by sucking, and the coating heads 15 perform coating of the new coating object area with the coating material.

Figure 2:
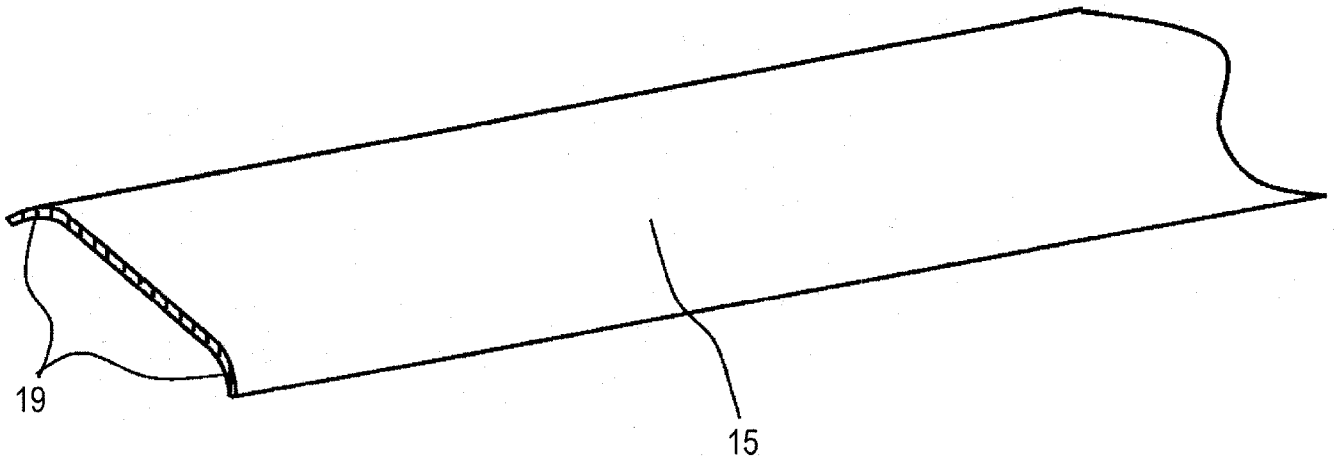
FIG. 2 is a diagram showing a curled state of a side end region of a film generated in a coating section shown in FIG. 1.

Incidentally, when the film 1 has contact with the suction table 10, the film 1 is in the state in which the tension in the longitudinal direction is applied to the film 1, and further, the portions of the film 1 located posterior and anterior to the suction table 10 are held by the suction bars 8, 9. Here, the longitudinal direction of the side surfaces of the guide roller 4 and the elevating guide roller 6, and the suction surface of the suction bar 8 in the wind-off section 16 is parallel to the Y-axis direction, namely the width direction of the film 1. Further, it is arranged that the film 1 is pressed against the guide roller 4, the elevating guide roller 6, and the suction bar 8 across the full width thereof. Similarly, in the wind-up section 18 it is also arranged that the film 1 is pressed against the suction bar 9, the elevating guide roller 7, and the guide roller 5 across the full width thereof, thus the film 1 becomes horizontal, namely parallel to the Y-axis across the full width thereof. However, since the film 1 is held by the suction bars 8, 9 with the tension in the longitudinal direction of the film 1 applied to the film 1, a difference in angle is caused between the direction of the tension and a curl direction in the area between the suction bars 8, 9 having a long distance, and curled portions 19 inclining downward are caused in both of the side end regions of the film 1 as shown in FIG. 2.

When the suction bars 8, 9, which holds the film 1 by sucking in the condition of applying the tension to the film 1, are moved downward to make the film 1 have contact with the suction table 10, the film 1 has contact with the suction table 10 with the curled portions 19 caused in both of the side end regions thereof. In this case, even by sucking the film 1 in the state described above on the suction table 10, the preferable suction condition can not necessarily be obtained.

In the coating section 17, the curl correction bars 13, 14 disposed on both sides of the suction table 10 in the Y-axis direction are for correcting the curled portions 19 caused in the both side end regions of the film 1.

Figure 3:
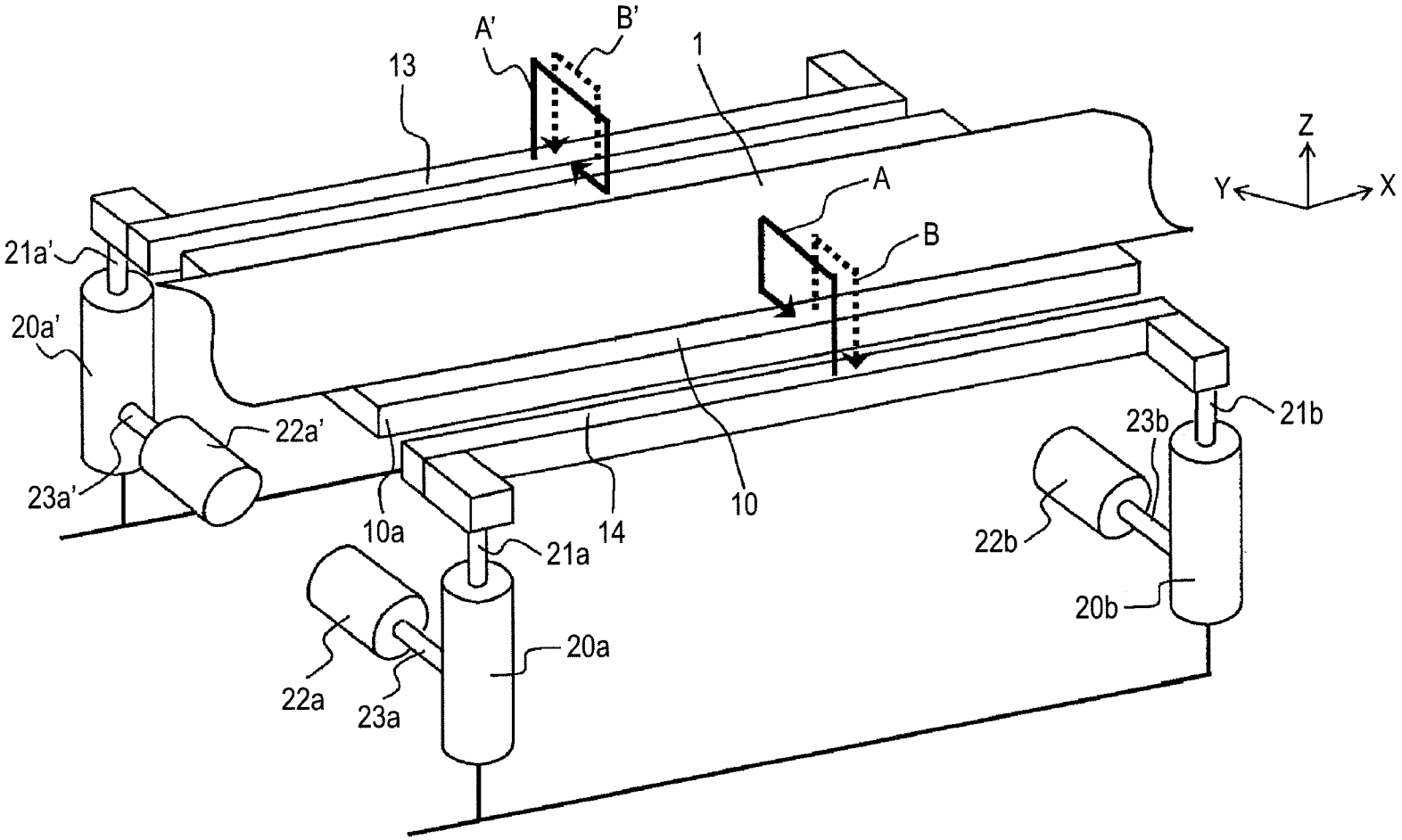
FIG. 3 is a schematic perspective view showing a specific example of a curl correction mechanism for the film in the first embodiment shown in FIG. 1.

FIG. 3 is a perspective view schematically showing a specific example of the curl correction bars 13, 14 and the drive mechanism therefor in the coating section 17 shown in FIG. 1. The reference number 10*a* denotes one side end region of the suction table 10, the reference numbers 20*a*, 20*b* denote elevating cylinders, the reference numerals 21*a*, 21*b* denote cylinder shafts, the reference numerals 22*a*, 22*b* denote widthwise shifting cylinders, the reference numerals 23*a*, 23*b* denote cylinder shafts, and the constituents corresponding to those shown in FIG. 1 are denoted by the same reference numerals, and the redundant explanation will be omitted.

In the drawing, the curl correction bar 14 has a longitudinal direction parallel to the X-axis direction, and is disposed on the side of the one side end region 10*a* of the suction table 10. The elevating cylinder 20*a* is disposed on one end of the curl correction bar 14, and the elevating cylinder 20*b* is disposed on the other end thereof. The both ends of the curl correction bar 14 are supported by the cylinder shafts 21*a*, 21*b* elevating using these elevating cylinders 20*a*, 20*b* as the drive sources. The elevating cylinders 20*a*, 20*b* are supplied with air pressure, and by controlling the air pressure in the elevating cylinders 20*a*, 20*b*, the cylinder shafts 21*a*, 21*b* are elongated and contracted (moved vertically) at the same time, and the curl correction bar 14 moves vertically while keeping the posture parallel to the X-axis direction.

Further, there are disposed the widthwise shifting cylinder 22*a* having the cylinder shaft 23*a* coupled to the elevating cylinder 20*a*, and the widthwise shifting cylinder 22*b* having the cylinder shaft 23*b* coupled to the elevating cylinder 20*b*, and these widthwise shifting cylinders 22*a*, 22*b* are also provided with air pressure controllers not shown for adjusting and controlling the air pressure applied thereto. By adjusting the air pressure applied to the widthwise shifting cylinders 22*a*, 22*b*, the cylinder shafts 23*a*, 23*b* are elongated and contracted simultaneously, and the elevating cylinders 20*a*, 20*b* move back and forth in the Y-axis direction.

Figure 4:
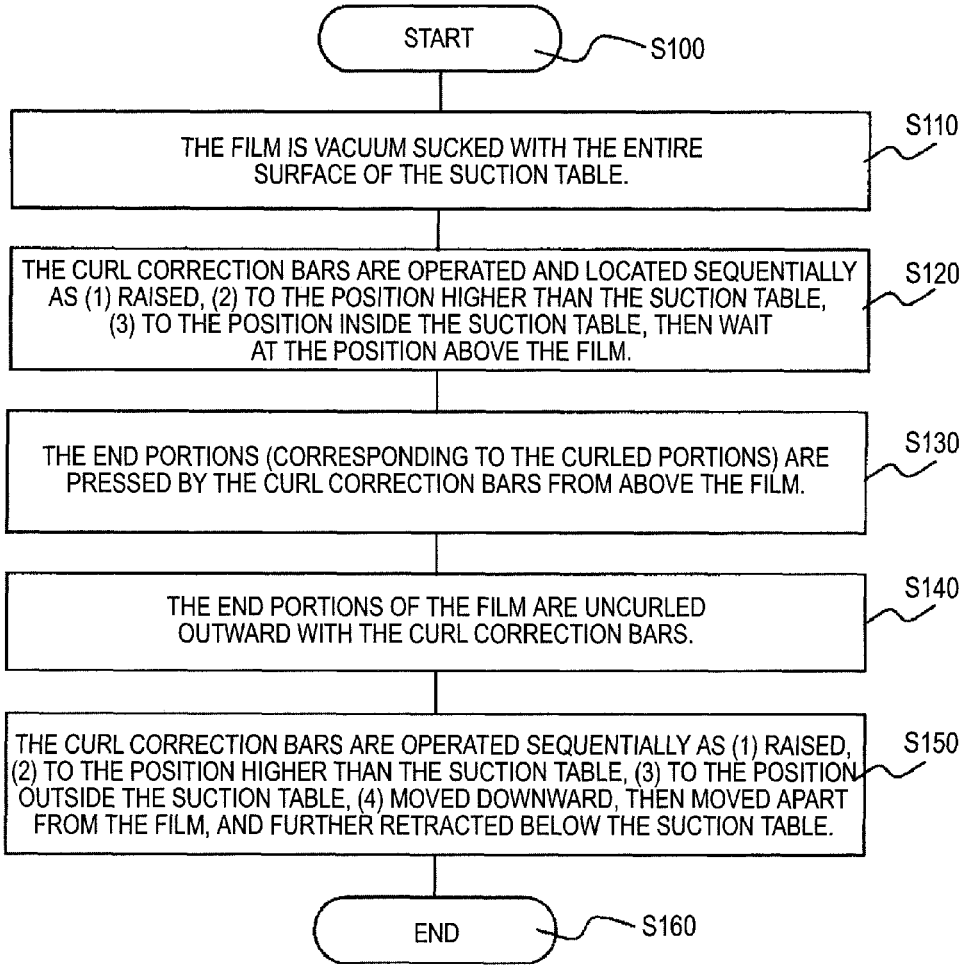
FIG. 4 is a flowchart showing a specific example of a curl correction operation for the film by curl correction bars shown in FIG. 3.

FIG. 4 is a flowchart showing a specific example of a curl correction operation for the film 1 by the curl correction bar 14 shown in FIG. 3. The specific example will hereinafter be explained with reference to FIG. 3.

In the drawing, the curl correction bar 14 is located at the position substantially opposed to the one side end region 10*a* of the suction table 10 when not in use. The position is referred to as a retracted position, and the state of the curl correction bar 14 located at the position is referred to as a retracted state.

When the succeeding coating object area of the film 1 reaches the coating section 17, the suction through suction holes provided on the suction surface of the suction table 10 is set to the state capable of vacuum contact, and the operation to the film 1 for coating the coating object area with the coating material is started (step S100). Subsequently, the film 1 with the tension applied thereto has vacuum contact with the suction table 10 (step S110). Subsequently, in the case of operating the curl correction bar 14 to thereby correct the curled portions 19 in the side end regions of the film 1, the elevating cylinders 20*a*, 20*b* and the widthwise shifting cylinders 22*a*, 22*b* are driven to raise the curl correction bar 14 in the Z-axis direction from the retracted state up to a first fixed position located above the film 1 on the suction table 10 as indicated by the solid arrow A. Subsequently, the curl correction bar 14 is moved horizontally in the direction (along the Y axis) of the film 1 up to a second fixed position beyond the curled portion 19 (FIG. 2) on the side of the side end region 10*a* of the suction table 10 in the film 1. When the curl correction bar 14 reaches (step S120) the second fixed position, the curl correction bar 14 is further moved downward (step S130) to a third fixed position at which the curl correction bar 14 presses the film 1 against the suction table 10. Then, while keeping the state of pressing the film 1 against the suction table 10, the curl correction bar 14 is moved backward toward the retracted position up to the vicinity of the side end region 10*a* of the suction table 10. Subsequently, the curl correction bar 14 is further moved (step S140) up to a fourth fixed position where the whole of the curled portions 19 in the film 1 is uncurled outward to be pressed against the suction surface of the suction table 10. Thus, the portion of the film 1 on the side of the side end region 10*a* of the suction table 10 also becomes flat as a whole, and as a result, the film 1 is pressed against the suction table 10 and has vacuum contact therewith.

When the correction of the curl is completed in such a manner as described above, the curl correction bar 14 is raised from the fourth fixed position to a fifth fixed position as indicated by the dashed arrow B. The curl correction bar 14 is moved horizontally from the fifth fixed position toward the retracted position, and when the curl correction bar 14 reaches a sixth fixed position right above the retracted position, the curl correction bar 14 is then moved downward to the retracted position to become in the retracted state (step S150). Thus, the curl correction operation in this coating object area is terminated (step S160).

It should be noted that although the explanation is omitted here, the same can be applied to the curl correction bar 13, and the drive mechanism therefor is denoted by the reference numerals of the corresponding constituents of the drive mechanism for the curl correction bar 14 added with an apostrophe. It should be noted that since the curl correction bar 13 is for correcting the curl in the side end region on the opposite side to the side end region in which the curl is corrected in the film 1 by the curl correction bar 14, the moving direction of the curl correction bar 13 along the Y-axis direction becomes the reverse direction as indicated by the arrows A', B'.

FIGS. 5A through 5F are diagrams showing the flow of the curl correction operation.

Figures 5A, 5B, 5C, 5D, 5E, 5F:
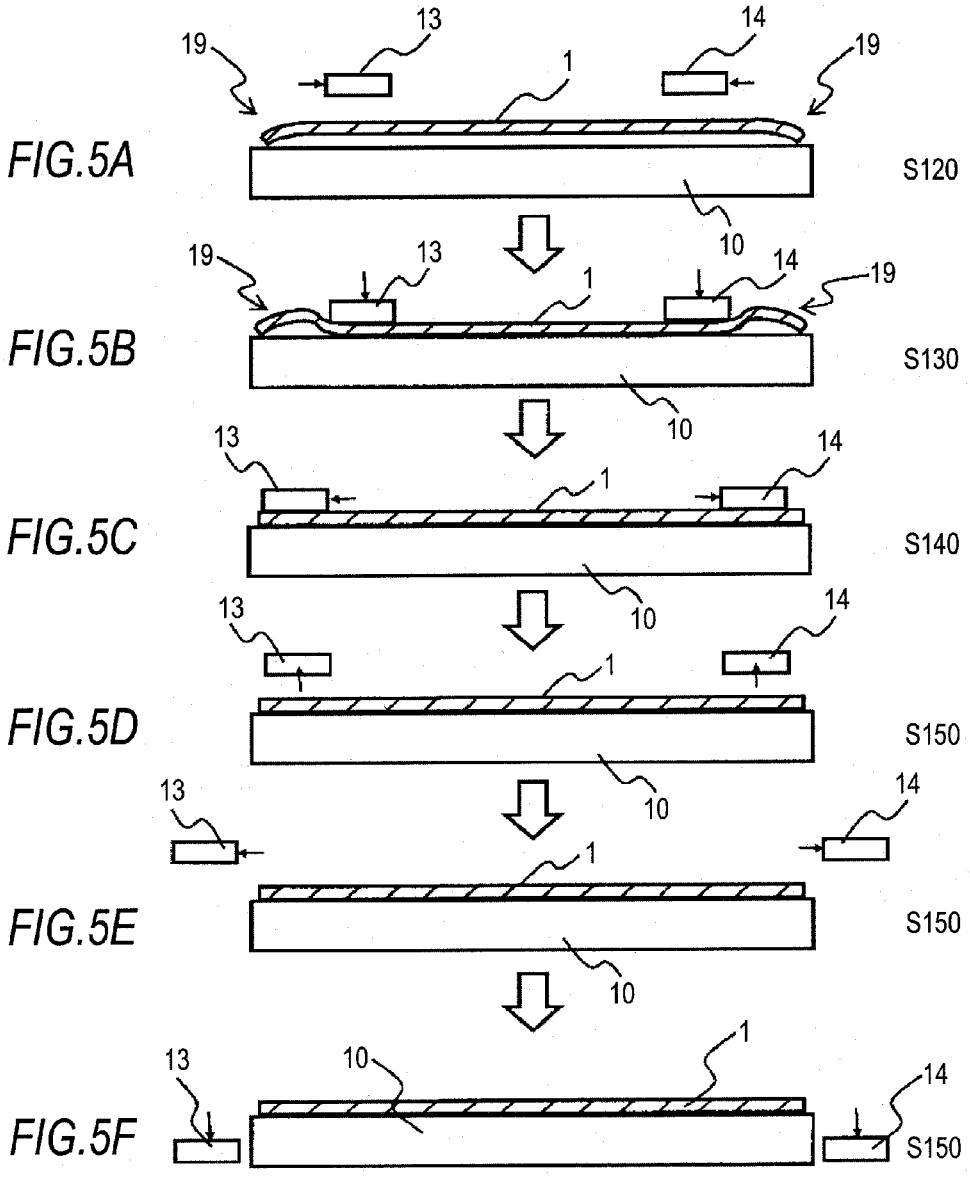
FIGS. 5A through 5F are diagrams showing flow of the curl correction operation shown in FIG. 4.

FIG. 5A is for showing the state of the curl correction bars 13, 14 corresponding to the step S120 shown in FIG. 4, and in this state the curl correction bars 13, 14 are moved from the respective retracted positions along the solid arrows A', A shown in FIG. 3, and are located at the second fixed positions.

FIG. 5B is for showing the state of the curl correction bars 13, 14 corresponding to the step S130 shown in FIG. 4, and in this state the curl correction bars 13, 14 are moved downward from the respective second fixed positions along the solid arrows A', A shown in FIG. 3, and are located at the third fixed positions where the curl correction bars 13, 14 press the film 1 against the suction table 10.

FIG. 5C is for showing the state of the curl correction bars 13, 14 corresponding to the step S140 shown in FIG. 4, and in this state the curl correction bars 13, 14 are moved from the third fixed positions toward the retracted positions, respectively, along the solid arrows A', A shown in FIG. 3, and are located at the fourth fixed positions while correcting the curl in the film 1.

FIG. 5D is for showing a first state of the curl correction bars 13, 14 corresponding to the step S150 shown in FIG. 4, and in this state the curl correction bars 13, 14 are raised from the respective fourth fixed positions along the dashed arrows B', B shown in FIG. 3, and are located at the fifth fixed positions where the curl correction bars 13, 14 are separated from the film 1. On this occasion, the curl in the film 1 has been corrected, and the entire surface of the film 1 has even contact with the suction table 10, and has stable vacuum contact therewith.

FIG. 5E is for showing a second state of the curl correction bars 13, 14 corresponding to the step S150 shown in FIG. 4 following the state shown in FIG. 5D, and in this state the curl correction bars 13, 14 are moved horizontally from the fifth fixed positions toward the retracted positions, respectively, along the dashed arrows B', B shown in FIG. 3, and are located at the sixth fixed positions right above the retracted positions.

FIG. 5F is for showing a third state of the curl correction bars 13, 14 corresponding to the step S150 shown in FIG. 4 following the state shown in FIG. 5E, and in this state the curl correction bars 13, 14 are moved downward from the sixth fixed positions to the retracted positions along the dashed arrows B', B shown in FIG. 3, and are located at the retracted positions.

As described above, in the condition in which the film 1 is sucked by the suction table 10, the coating is performed on the coating object area in the film 1 with the coating material using the coating heads 15. When the coating operation is terminated, the elevating guide rollers 6, 7 are raised to lift the film 1 from the suction table 10. Subsequently, by driving the wind-off film roll 2 and the wind-up film roll 3, the conveyance of the film 1 is resumed so that the succeeding coating object area of the film 1 is positioned at the coating section 17.

In the operation described above, the force with which the curl correction bars 13, 14 press the film 1 against the suction table 10 and the force for uncurling the film 1 in the states shown in FIGS. 5B and 5C can be controlled by controlling the setting pressure of the elevating cylinders 20*a*, 20*b* for moving the curl correction bars 13, 14. Further, the speed of the curl correction bars 13, 14 at the time of uncurling the film 1 in the transition from the state shown in FIG. 5B to the state shown in FIG. 5C can be set to a desired speed by an airflow control section such as speed control valves for the widthwise shifting cylinders 22*a*, 22*b*.

As described above, according to the first embodiment, the slack in the film 1 can be eliminated when coating the surface of the film 1 with the coating material in the coating section 17, and at the same time, the curl in the side end regions of the film 1 caused by applying the tension to the film 1 in order to eliminate the slack can also be eliminated, and therefore, it becomes possible to make the film 1 have stable vacuum contact with the suction table 10 with high accuracy to thereby coat the film 1 with the coating material with high accuracy.

Figure 6:
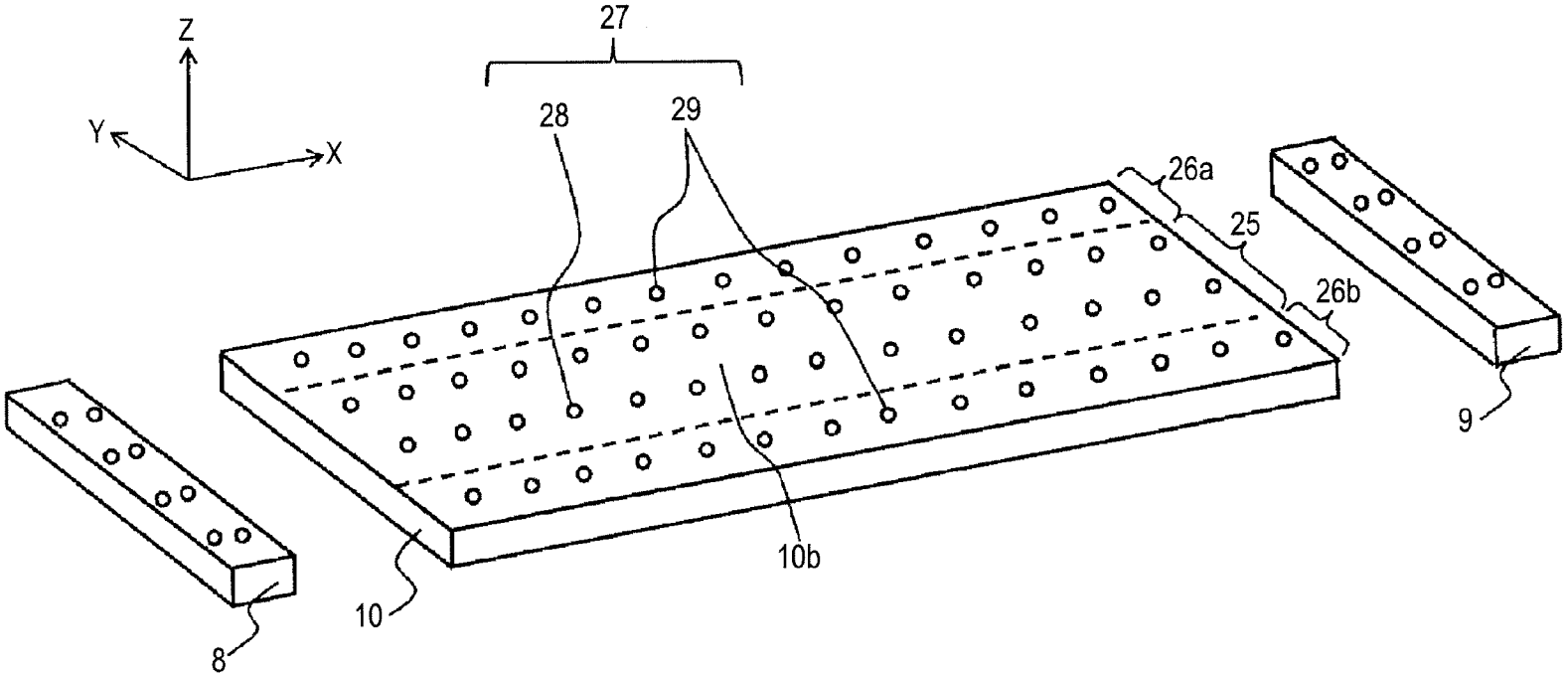
FIG. 6 is a perspective view showing a specific example of a suction table in an inkjet coating device and an inkjet coating method according to a second embodiment of the invention.

FIG. 6 is a perspective view showing the suction table in an inkjet coating device and an inkjet coating method according to a second embodiment of the invention, wherein the reference numeral 24 denotes the suction surface, the reference numeral 25 denotes a central area suction section, the reference numerals 26*a*, 26*b* denote peripheral area suction sections, the reference numeral 27 denotes suction holes, the reference numeral 28 denotes central area suction holes, the reference numeral 29 denotes peripheral area suction holes, and the constituents corresponding to those shown in FIG. 1 are denoted by the same reference numerals, and the redundant explanation therefor will be omitted.

In the second embodiment, although the inkjet coating device also has the configuration shown in FIG. 1 similarly to the case of the first embodiment described above, there is a difference in the method (i.e., the suction control) of the suction in the suction table 10.

Specifically, in FIG. 6, although the suction surface 24 of the suction table 10 is provided with a plurality of suction holes 27 for vacuum sucking the film 1 disposed evenly, in the second embodiment the suction surface 10*b* is sectioned into three areas in the width direction (the direction (the Y-axis direction) perpendicular to the conveying direction of the film 1), namely the central area suction section 2S in the central area, and the peripheral area suction sections 26*a*, 26*b* on the both sides of the central area suction section 25. It is arranged that, under the control of the control section not shown, the control of the suction holes 27 in the central area suction section 2S, namely the central area suction holes 28, and the control of the suction holes 27 in the peripheral area suction sections 26*a*, 26*b*, namely the peripheral area suction holes 29 are performed independently and in a temporally-shifted manner.

In the second embodiment, the operation of the curl correction bars 13, 14 is substantially the same as the operation in the above-described first embodiment shown in FIGS. 5A through 5F. When detecting the arrival of the coating object area of the film 1 at the coating section 17 (FIG. 1), the control section starts the operation of the central area suction holes 28 of the central area suction section 25 in the suction surface 24 of the suction table 10. Further, the central area suction holes 28 are in the suction operation state in at least the state shown in FIG. 5A. In contrast thereto, in the peripheral area suction sections 26*a*, 26*b*, it is arranged that the control section performs the control of starting the suction operation of the peripheral area suction holes 29 when the curl correction bars 13, 14 are in any one of the state shown in FIG. 5B through the state shown in FIG. 5D, the curled portions 19 of the film 1 are corrected, and the control section detects the termination of the curl correction operation. It should be noted that when the coating operation with the coating material in the coating object area of the film 1 is terminated, the control section detects the termination and then terminates the suction operation of the central area suction holes 28 and the peripheral area suction holes 29.

Figure 7:
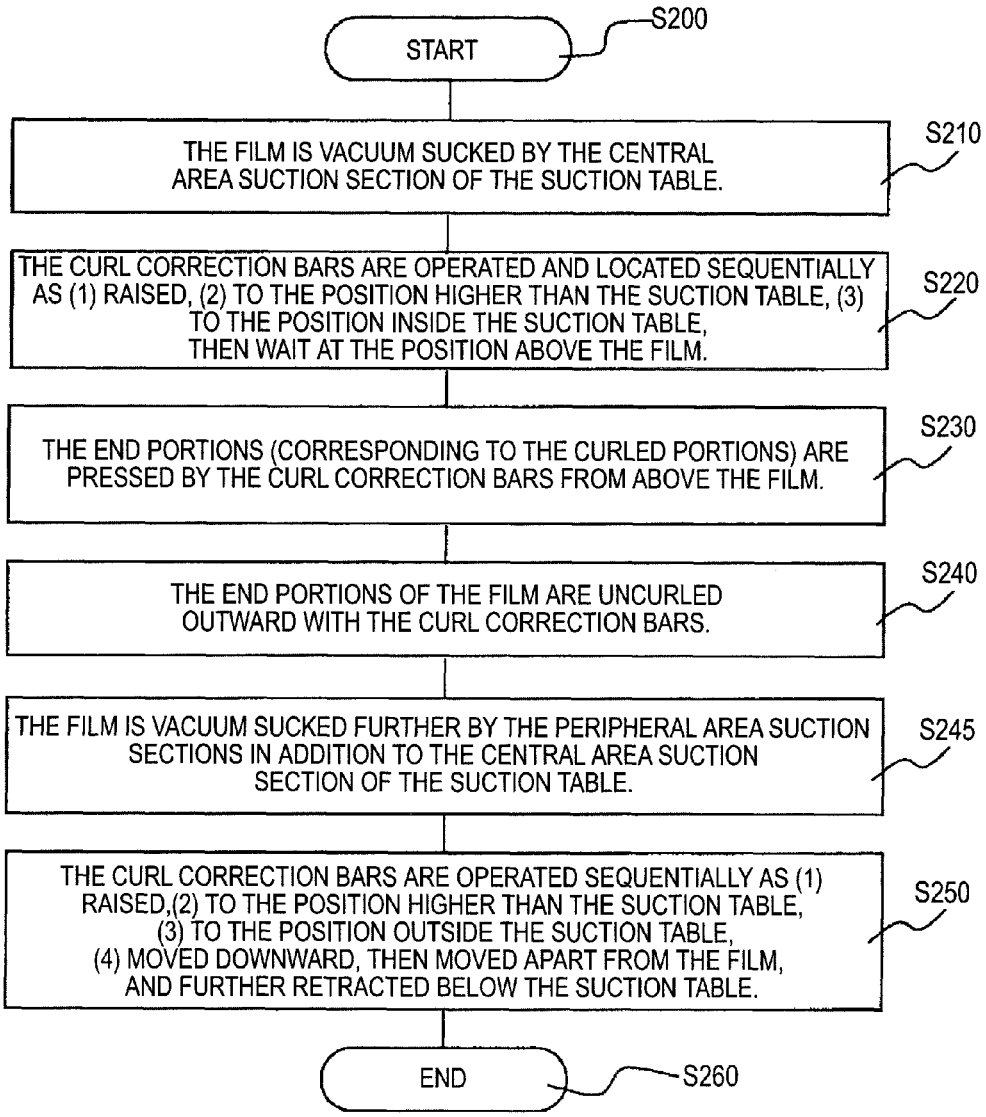
FIG. 7 is a flowchart showing a specific example of a curl correction operation for the film in the second embodiment provided with the suction table shown in FIG. 6.

FIG. 7 is a flowchart showing the suction operation of the suction table 10 with respect to the film 1 in the second embodiment. The suction operation will be explained with reference to FIGS. 1, 5A through 5F, and 6.

In FIG. 1, when the film 1 is wound off from the wind-off film roll 2 and then conveyed, all of the suction holes 27 in the suction table 10 shown in FIG. 6 are in a non-suction state. When the succeeding coating object area of the film 1 reaches the coating section 17, the suction operation is started in the central area suction holes 28 of the central area suction section 25 in the suction table 10 shown in FIG. 6. Then, in such a state, by moving the suction bars 8, 9 downward as described above, the film 1 (FIG. 1) has contact with the suction surface 24 of the suction table 10. On this occasion, since the central area suction holes 28 of the central area suction section 25 in the suction table 10 are in the suction operation, the film 1 is held by the central area suction holes 28 in the area having contact with the central area suction section 25 by vacuum sucking. In contrast thereto, since the suction operation is not performed in the peripheral area suction holes 29 of the peripheral area suction sections 26*a*, 26*b* in the suction table 10, the film 1 is not held by sucking (step S210 in FIG. 7) in the area opposed to the peripheral area suction sections 26*a*, 26*b*.

Then, similarly to the case of the first embodiment described above, the curl correction bars 13, 14 are operated to make a transition to the state (step S220 in FIG. 7) in which the curl correction bars 13, 14 are located at the second fixed positions shown in FIG. 5A, subsequently, the curl correction bars 13, 14 move downward to the third fixed positions shown in FIG. 5B to make (step S230 in FIG. 7) a transition to the state in which the curl correction bars 13, 14 press the film 1 against the suction table 10, and then the curl correction bars 13, 14 are moved from the third fixed positions to the fourth fixed positions to uncurl by pressing the side end regions of the film 1 shown in FIG. 5C toward the side end region of the suction table 10, thereby performing (step S240 in FIG. 7) the curl correction in the side end regions.

As described above, in the state in which the curl correction bars 13, 14 are located at the fourth fixed positions, and the curl in the side end regions of the film 1 is corrected, the peripheral area suction holes 29 of the peripheral area suction sections 26*a*, 26*b* of the suction surface 24 of the suction table 10 start the suction operation, and the peripheral area suction holes 29 hold (step S245 in FIG. 7) the side end region of the film 1 with the curl corrected in the peripheral area suction sections 26*a*, 26*b* of the suction table 10 by vacuum sucking. In such a manner as described above, the film 1 is held by vacuum sucking in the suction table 10 with the entire coating object area of the film 1 kept flat.

Subsequently, similarly to the case of the first embodiment described above, the curl correction bars 13, 14 make transition to the state (step S250 in FIG. 7) in which the curl correction bars 13, 14 are at the retracted positions shown in FIG. 5F from the state shown in FIG. 5C through the states shown in FIGS. 5D and 5E, and then the curl correction operation for the film 1 is terminated (step S260 in FIG. 7).

As described above, in the state in which the film 1 is sucked on the suction table 10, the coating process is performed in the coating object area of the film 1 using the coating heads 15 (FIG. 1), and when the coating operation is terminated, the elevating guide rollers 6, 7 are raised to lift the film 1 from the suction table 10, and then the wind-off film roll 2 and the wind-up film roll 3 are driven to thereby resume the conveyance of the film 1 so that the succeeding coating object area of the film 1 is positioned in the coating section 17.

As described above, also in the second embodiment, it is possible to hold the film 1 with the curl corrected in the coating section 17 by vacuum sucking, and as a result, advantages substantially the same as those in the first embodiment described above can be obtained.

Figure 8:
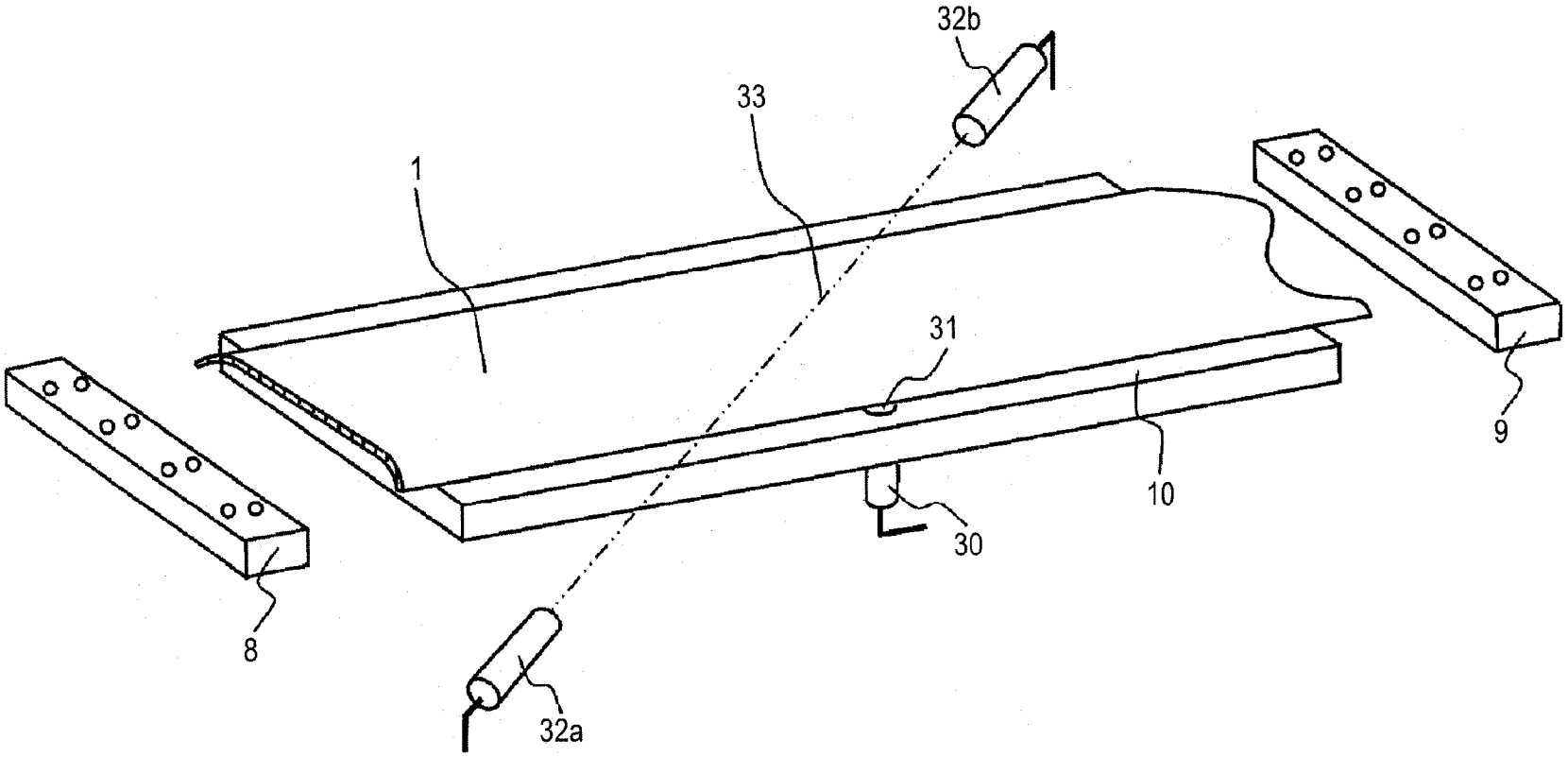
FIG. 8 is a schematic perspective view showing a substantial part of an inkjet coating device and an inkjet coating method according to a third embodiment of the invention.

FIG. 8 is a schematic perspective view showing a substantial part of an inkjet coating device and an inkjet coating method according to a third embodiment of the invention, wherein the reference numeral 30 denotes a film presence/absence detection sensor of a film uplift detection device, the reference numeral 31 denotes a detection hole of the film uplift detection device, the reference numeral 32*a* denotes a beam generation device of the film uplift detection device, the reference numeral 32*b* denotes a detection sensor of the film uplift detection device, the reference numeral 33 denotes the beam, and constituents corresponding to those shown in FIG. 1 are denoted by the same reference numerals, and the redundant explanation will be omitted.

In the third embodiment, a device for performing detection of whether or not the curl correction operation is terminated is additionally provided to the configurations of the first and the second embodiments described above. Hereinafter, such a device will be referred to as a film uplift detection device.

In FIG. 8, the detection hole 31 penetrating the suction table 10 from the upper surface (the suction surface) to the lower surface (the reverse side) is disposed in the side end region of the suction table 10, the film presence/absence detection sensor 30 of an optical reflective type is disposed on the reverse side of the suction table 10 so as to be opposed to the detection hole 31, and the film uplift detection device is composed of the detection hole 31 and the film presence/absence detection sensor 30.

The detection hole 31 is disposed at a position where the curled portion 19 (FIG. 2) caused in the present film 1 is located when the film 1 is mounted on the suction table 10. The film presence/absence detection sensor 30 emits light through the detection hole 31. The film presence/absence detection sensor 30 receives the reflected light from the reverse side of the film 1 mounted on the suction table 10 through the detection hole 31, and detects the amount of the reflected light received in accordance with the distance to the reflecting surface. However, the distance from the film presence/absence detection sensor 30 to the reverse side of the film 1 reflecting the irradiating light is different between the case in which the curled portions 19 exist in the side end regions of the film 1 and the side end regions of the film 1 are lifted from the suction table 10 as shown in FIG. 5A, and the case in which the curl correction has been performed and the side end regions of the film 1 are planarized to have contact with the suction surface of the suction table 10 as shown in FIG. 5C.

Therefore, when the curl correction operation for the film 1 described above is terminated, the film presence/absence detection sensor 30 applies the light through the detection hole 31. Further, by receiving the reflected light from the reverse side of the film 1 mounted on the suction table 10 through the detection hole 31, a processing section not shown measures the distance to the reverse surface of the film 1 based on the reception result. By processing the measurement result, whether the reverse side of the film 1 is lifted from the suction table 10 or the reverse side of the film 1 has contact with the suction table 10 in a flattened state is determined. If the determination result that the reverse side of the film 1 is lifted from the suction table 10 is obtained, it is judged that the curl correction on the film 1 fails to be performed, and then the operator of the device is informed of this fact, and at the same time, the device is stopped to halt the coating operation.

In the third embodiment, there are further provided the beam generation device 32*a* disposed outside one of the side end regions of the suction table 10 and the detection sensor 32*b* disposed outside the other of the side end regions. Further, the light beam 33 from the beam generation device 32*a* is received by the detection sensor 32*b*. The beam generation device 32*a* and the detection sensor 32*b* constitute the film uplift detection device. Regarding the layout positions of the beam generation device 32*a* and the detection sensor 32*b*, it is required to satisfy both of the following two conditions. The first condition is to arrange so that the light beam 33 from the beam generation device 32*a* traverses the suction table 10 above the suction table 10. The second condition is that it is arranged that the light beam 33 from the beam generation device 32*a* can be detected by the detection sensor 32*b* in the case in which the film 1 is vacuum sucked by the suction table 10 in a flat state as a whole, and it is also arranged that the light beam 33 from the beam generation device 32*a* is blocked by the film 1, and fails to be received by the detection sensor 32*b* in the case in which the curled portions 19 (FIG. 2) are caused and the film 1 is lifted from the suction surface 24 (FIG. 6) of the suction table 10.

Thus, in the processing section not shown, it is judged that the entire film 1 is held by the suction table 10 by vacuum sucking in a flat state if the reception result of the light beam 33 is obtained in the detection sensor 32*b* after the termination of the curl correction operation for the film 1 described above. Further, the coating operation on the film 1 with the coating material is started. If the reception result of the light beam 33 fails to be obtained by the detection sensor 32*b*, it is judged that the curl correction for the film 1 has not been successful. Then, the operator of the device is informed of the fact as an occurrence of an error, and at the same time, the operation of the device is stopped to halt the coating operation.

As described above, according to the third embodiment, since whether or not the curl correction has surely been performed can be confirmed using the film uplift detection device after the curl correction for the film 1 has been performed, the coating with the coating material in the condition in which the curl correction is not sufficiently performed can be prevented.

It should be noted that although in the explanation described above, it is assumed to use both of the film uplift detection device composed of the film presence/absence detection sensor 30 and the detection hole 31, and the film uplift detection device composed of the beam generation device 32*a* and the detection sensor 32*b*, it is also possible to use either one of these film uplift detection devices. Further, it is also possible to use a plurality of the same film uplift detection devices. Such film uplift detection devices are used selectively in accordance with the curl condition of the film 1.

In any of these cases, by adopting the procedure in which it is not until the curl of the film 1 is corrected and the film 1 becomes in the flat state that the process proceeds to the succeeding coating process, reliability can dramatically be improved. If the correction of the curl fails to be completed, and the manufacturing process is suspended, the operator is informed of the error by an alarm or the like. In this case, although waste is incurred in the production time, it becomes possible to prevent such problems as degrading of the yield of the products such as starting of the coating operation with the film 1 lifted therefrom or leaving of the wrinkles caused therein.

Figure 9:
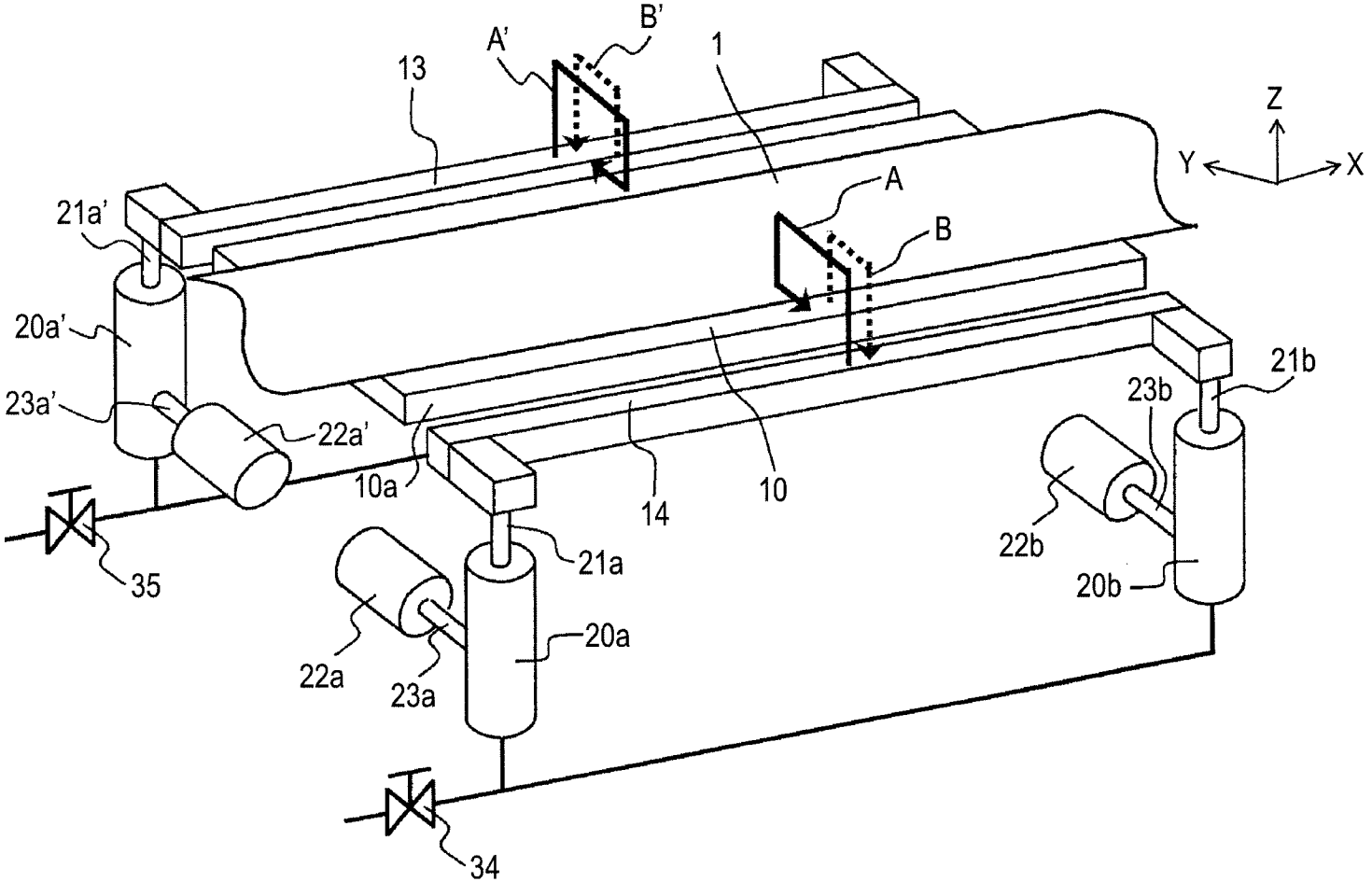
FIG. 9 is a schematic perspective view showing a specific example of a curl correction device in an inkjet coating device and an inkjet coating method according to a fourth embodiment of the invention.

FIG. 9 is a schematic perspective view showing a specific example of a curl correction device in an inkjet coating device and an inkjet coating method according to a fourth embodiment of the invention. The reference numerals 34, 35 denote air pressure regulators, and the constituents corresponding to those shown in FIG. 3 are denoted by the same reference numerals, and the redundant explanation will be omitted.

In the drawing, the elevating cylinders 20*a*, 20*b* are supplied with the compressed air via the air pressure regulator 34. In the same manner, the elevating cylinders (only the elevating cylinder 20*a*' out of the elevating cylinders 20*a*', 20*b*' is illustrated here) for vertically moving the curl correction bar 13 disposed on the opposite side of the suction table 10 is also supplied with the compressed air via the air pressure regulator 35.

Generally, electropneumatic regulators convert electric signals into air pressure signals to provide them as power sources for driving. The air pressure regulators 34, used here are also the devices called an electropneumatic regulator, and convert the control signal from the control device not shown into the air pressure, and then output the air pressure to the elevating cylinders 20*a*, 20*b* and the elevating cylinder 20*a*'.

Therefore, by the control device changing the control signals to be supplied to the air pressure regulators 34, 35, the air pressure supplied to the elevating cylinders 20*a*, 20*b* and the elevating cylinder 20*a*' can be changed. Further, when the air pressure supplied to the elevating cylinders 20*a*, 20*b*, and the elevating air cylinder 20*a*' is changed, the drive pressure for the vertical motions of the curl correction bars 14, 13 is changed. Further, the pressing force with which the curl correction bars 14, 13 press the film 1 against the suction table 10 is also changed.

Therefore, by the control device controlling the air pressure regulators 34, 35, the pressing force with which the curl correction bars 14, 13 press the film 1 against the suction table 10 can be controlled. Thus, it becomes possible to preferably correct the curl of the film 1 to make the entire coating object area of the film 1 become in a flattened state with high accuracy, thereby making the suction table 10 hold the film 1 by vacuum sucking.

Figure 10:
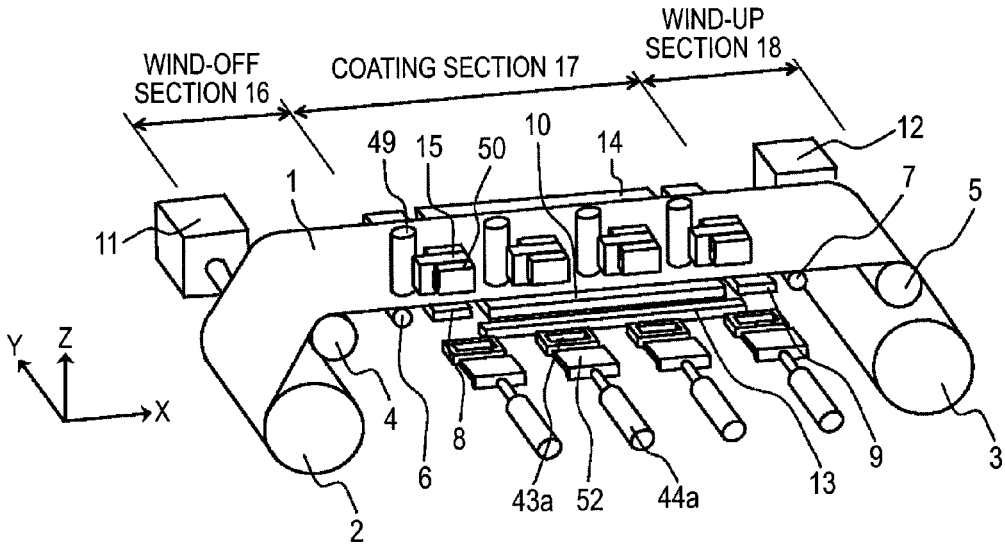
FIG. 10 is a perspective view showing a schematic configuration of an inkjet coating device and an inkjet coating method according to a fifth embodiment of the invention.

FIG. 10 is a perspective view showing a schematic configuration of an inkjet coating device and an inkjet coating method according to a fifth embodiment of the invention. The reference numeral 49 denotes imaging cameras, the reference numeral 50 denotes UV light sources, the reference numeral 43*a* denotes vacuum suction sections, the reference numeral 52 denotes UV shutters, the reference numeral 44*a* denotes suction section air cylinders, and constituents corresponding to those shown in FIG. 1 are denoted by the same reference numerals, and the redundant explanation will be omitted.

In the present embodiment, a coating material of a UV-curing type, namely a UV-curing coating material, is used as the coating material, and therefore, handling of the coating material of a UV-curing type will be explained.

In the drawing, in the suction bars 8, 9 and the suction table 10, fixing by sucking and releasing of the film 1 are performed by vacuum valves using the vacuum pump not shown as a vacuum source.

In the coating section 17, a plurality (four in this case) of inkjet coating heads 15 is provided. Each of the coating heads 15 can individually change the height by a Z-axis drive section not shown. Further, the coating heads 15 each constitute a unit together with the imaging camera 49 and the UV light source 50, and are configured to be able to be moved in the X-axis direction by an X-axis drive section not shown.

It should be noted that although it is assumed here that there are provided four coating heads 15 each constituting the unit together with the imaging camera 49 and the UV light source 50, the number of coating heads 15 can be one or more other than four. The reason therefor is that a plurality of coating heads can improve the processing speed.

Outside the suction table 10, there are disposed vacuum suction sections 43*a* for sucking the inside of the nozzles corresponding respectively to the coating heads 15. Further, the vacuum suction sections 43*a* are each provided with the UV shutter 52, which can move (slide) reciprocally with the suction section air cylinder 44*a*. The UV shutter 52 has a shape like a lid for a suction port of the vacuum suction section 43*a*. When performing the vacuum suction of the inside of the nozzles of each of the coating heads 15, the UV shutter 52 is removed by the suction section air cylinder 44*a* from the suction port of the vacuum suction section 43*a* to thereby open the suction port. When not performing the vacuum suction of the inside of the nozzles of each of the coating heads 15, the UV shutter 52 is moved by the suction section air cylinder 44*a* so as to cover the suction port of the vacuum suction section 43*a* to thereby close the suction port.

Figure 11:
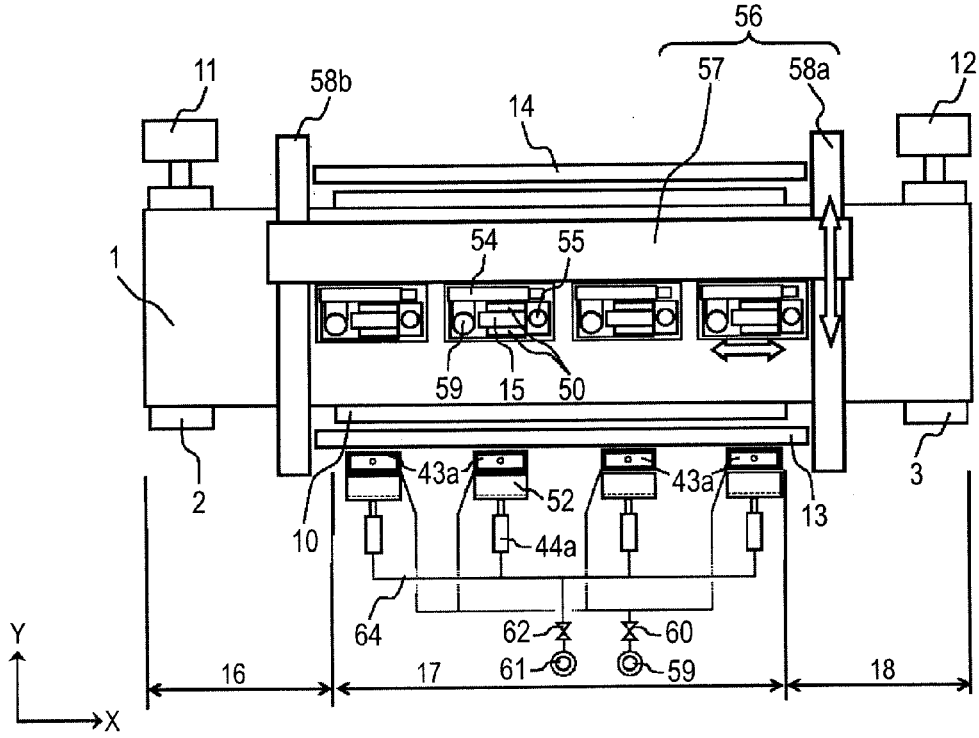
FIG. 11 is a top view showing a schematic configuration of the fifth embodiment shown in FIG. 10.

FIG. 11 is a top view showing a schematic configuration of the fifth embodiment shown in FIG. 10. The reference numeral 54 denotes an X-axis drive section, the reference numeral 55 denotes a Z-axis drive section, the reference numeral 56 denotes a Y-axis drive section, the reference numeral 57 denotes a gantry, the reference numeral 58*a*, 58*b* denote a Y-axis stage, the reference numeral 59 denotes a vacuum pump, the reference numeral 60 denotes a vacuum valve, the reference numeral 61 denotes a pressurized air source, the reference numeral 62 denotes a valve unit, the reference numeral 63 denotes vacuum plumbing, the reference numeral 64 denotes plumbing, and the constituents corresponding to those shown in FIG. 10 are denoted by the same reference numerals, and redundant explanation will be omitted.

In the drawing, the four coating heads 15 are arranged in the X-axis direction, namely along the longitudinal direction of the film 1. The two Y-axis stages 58*a*, 58*b* are disposed in parallel to each other in the Y-axis direction so as to include the entire arrangement of the coating heads 15 in between and stride over the film 1, and further, the gantry 57 is mounted on the Y-axis stages 58*a*, 58*b* in parallel to the X-axis so as to stride over the Y-axis stages 58*a*, 58*b*. The four coating heads 15 are attached to a side surface of the gantry 57 extending along the longitudinal direction thereof. The gantry 57 can be moved on the Y-axis stages 58*a*, 58*b* in the Y-axis direction by a drive section not shown such as a servomotor or a linear motor. Thus, the Y-axis stages 58*a*, 58*b* and the gantry 57 constitute the Y-axis drive section 56 for moving the coating heads 15 in the Y-axis direction.

Further, each of the coating heads 15 is provided with the X-axis drive section 54 for moving the coating head 15 in the X-axis direction along the gantry 57, and the Z-axis drive section 55 for vertically (in the Z-axis direction perpendicular to the sheet of the drawing) moving the coating head 15 along the side surface described above of the gantry 57.

As described above, each of the coating heads 15 is moved in the X-axis direction and the Y-axis direction in parallel to the surface of the film 1 by the X-axis drive section 54 and the Y-axis drive section 56, and is moved in the Z-axis direction perpendicular to the surface of the film 1 by the Z-axis drive section 55.

The vacuum plumbing 63 is connected to each of the vacuum suction sections 43*a*, and is further connected to each of the vacuum pumps 59 via the vacuum valve 60. When the vacuum pump 59 operates, and the vacuum valve 60 opens in such a condition, suction is performed in each of the vacuum suction sections 43*a*.

Further, the plumbing 64 is connected to each of the suction section air cylinders 44*a*, and the plumbing 64 is connected to the pressurized air source 61 as a cylinder drive section via the valve unit 62. Generally, the UV shutter 52 is positioned above the vacuum suction section 43*a* so as to be biased by a spring to block the suction port of the vacuum suction section 43*a*. When sucking the inside of the nozzles of the coating head 15, the pressurized air source 61 operates, and at the same time, the valve unit 62 opens. Thus, the suction section air cylinder 44*a* operates to move the UV shutter 52 so as to be removed from the vacuum suction section 43*a*. Further, the suction port of the vacuum suction section 43*a* is opened. At the same time, the vacuum pump 59 operates to open the vacuum valve 60 to thereby perform suction in the vacuum suction section 43*a*. When the suction is terminated, and the valve unit 62 is closed, and then the pressurized air source 61 stops the operation, the operation of the suction section air cylinder 44*a* also stops, the UV shutter 52 is moved to the position above the vacuum suction section 43*a* due to the operation of the spring or the like, and the suction port of the vacuum suction section 43*a* is closed.

As described above, the coating heads 15 of the inkjet type are moved in the X-axis direction and the Y-axis direction above the film 1 using the X-axis drive section 54 and the Y-axis drive section 56, and the liquid electrode material, the liquid insulating material, and so on (hereinafter collectively referred to as a "coating material") are ejected from the nozzles provided to the coating heads 15, thereby applying the coating material on the film 1 to form the electrodes and the insulating films.

Figure 12:
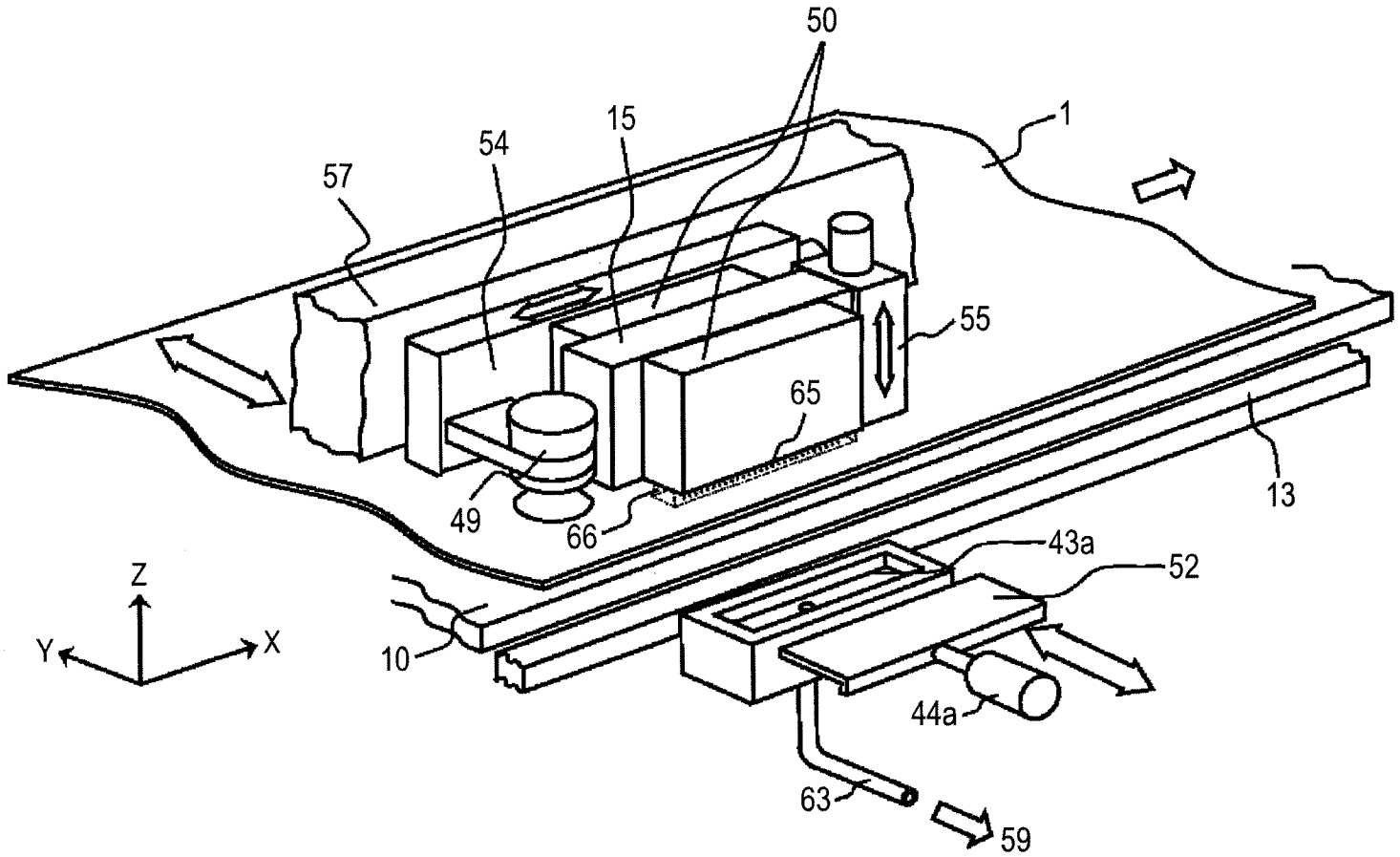
FIG. 12 is a perspective view showing a portion corresponding to one of coating heads shown in FIGS. 10 and 11 in an enlarged manner.

FIG. 12 is a perspective view showing a portion corresponding to one of the coating heads 15 shown in FIGS. 10 and 11 in an enlarged manner. The reference numeral 65 denotes the UV-curing coating material, and the reference numeral 66 denotes UV light. The constituents corresponding to those shown in FIGS. 10 and 11 are denoted by the same reference numerals, and the redundant explanation will be omitted.

In the drawing, the lower surface of the coating head 15 is provided with approximately 250 nozzles (not shown) opposed to the film 1. The droplets of the coating material 65 are ejected to the surface of the film 1 to form dots while pushing out the droplets of the coating material 65 by piezoelectric drive in each of the nozzles. The UV light sources 50 are disposed respectively on the anterior and posterior sides (in the Y-axis direction) of the coating head 15, and the UV light 66 is emitted from the lower surface of each of the UV light sources 50 to the surface of the film 1.

The coating head 15 can be moved in the Z-axis direction (the height direction) by the Z-axis drive section 55 together with the imaging camera 49 and the UV light sources 50 as the light sources of the ultraviolet light. All of the constituents which can be moved in the Z-axis direction are attached to the X-axis drive section 54. Further, a plurality of X-axis drive sections 54 are attached to the gantry 57 of the Y-axis drive section 56 forming the common gantry structure. It is arranged that all of the coating heads 15 can be moved in the X-Y plane. Thus, as explained with reference to FIG. 11, the nozzles of the coating heads 15 are moved in the X-Y plane, and further moved in the Z-axis direction. Therefore, by individually ejecting the coating material 65, it becomes possible to apply the coating material 65 precisely on the coating surface of the film 1 with any patterns.

If bubbles enter the inside of the coating head 15, failure in ejection coating of the coating material is caused, which may cause a serious problem. Therefore, it is necessary to avoid incorporation of the bubbles into the inside of the coating head 15 as much as possible. As a phenomenon having a possibility of incorporating the bubbles into the inside of the coating head 15, there can be cited roughly two phenomena. Firstly, there can be cited the case of newly filling the coating head 15 with the UV-curing coating material due to consumption of the coating material. Secondly, there can be cited the case in which fine bubbles are generated inside the coating head 15 due to a long continuous coating operation.

In order to prevent the bubble incorporation into the inside of the coating head 15, it is effective to perform vacuum suction of the inside of the coating head 15 through the nozzles. In order to perform the vacuum suction in a short period of time, the layout of the coating heads 15 is arranged to match with the layout of the corresponding vacuum suction sections 43*a*. The coating heads 15 are moved simultaneously by the respective X-axis drive sections 54 and the respective Y-axis drive sections 56 (FIG. 11) until the nozzles are positioned above the corresponding vacuum suction sections 43*a*. Subsequently, each of the heads 15 is moved downward by the Z-axis drive section 55 so that the tips of the nozzles get into the suction port of the vacuum suction section 43*a*. In this state, in the vacuum suction sections 43*a*, the vacuum suction of the respective coating heads 15 is performed simultaneously through the ejection ports of the nozzles.

When the coating with the coating material 65 in the predetermined coating object area of the film 1 is terminated in the coating section 17, winding-off of the film 1 from the wind-off film roll 2 (FIGS. 10 and 11) and winding-up of the film 1 to the wind-up film roll 3 (FIGS. 10 and 11) are performed, the coating operation is repeated on the continuous film 1 with the coating heads 15 in the coating section 17.

In the case in which the vacuum suction of the coating heads 15 is performed in the vacuum suction section 43*a* through the nozzles of the coating heads 15, there is a possibility that some of the UV-curing coating material stored inside the coating heads 15 is splashed. The UV-curing coating material is attached to the inside wall surfaces of the vacuum suction section 43*a* and the inside surface of the vacuum plumbing 63 in an incremental manner. On the other hand, since the UV light sources 50 emit the UV light 66 beside the coating heads 15 after the normal coating operation, the UV-curing coating material attached to the inside of the vacuum suction sections 43*a* starts to cure. Therefore, there arises a problem that the channel of the vacuum suction such as the vacuum plumbing 63 is blocked.

As a counter measure thereof, a method of disposing the vacuum suction section at a position far distant from the UV light sources has ever been proposed. However, since it takes long time for the coating heads to move to the vacuum suction section, there arises another problem that degradation in takt time of the process is incurred. Further, as another proposal, there has been proposed a pressurized filling method of adding a pressurizing system to the material supply system of the coating head instead of the vacuum suction process. However, according to this method, since an additional space is required, and further, pressure fluctuation is caused due to the switching valve, a harmful influence is exerted on the ejection state to which preciseness is required, and it becomes difficult to perform high-quality coating.

The vacuum suction sections 43*a* are originally provided in order to prevent incorporation of bubbles into the inside the coating heads 15. In the fifth embodiment, in order to solve the problem described above, the UV shutter 52 is added to the vacuum suction section 43*a* on the ground of preventing the degradation of the vacuum suction function due to the curing of the coating material 65.

Specifically, in FIG. 12, the film 1 thus conveyed is aligned and then fixed by the suction table 10, and the vacuum suction section 43*a* is disposed at an outer position in a direction perpendicular to the conveying direction and in the vicinity of the suction table 10. The upper surface of the vacuum suction section 43*a* performs vacuum suction operation through the vacuum plumbing 63 coupled to the vacuum pump 59. It is arranged that the UV shutter 52 can be moved slidably in the direction perpendicular to the conveying direction of the film 1 on the upper surface of the vacuum suction section 43*a*, which can be opened, from the outside position of the vacuum suction section 43*a* while being driven by the suction section air cylinder 44*a* for driving the shutter. Here, although it is assumed that the drive source of the UV shutter 52 is the suction section air cylinder, something which makes the movement by a linear motion possible such as other motors or solenoids can also be adopted.

FIG. 13 is a block diagram showing a configuration of a control section for inkjet coating having a function of UV shield of a vacuum suction section 43*a* shown in FIG. 10. The reference numeral 54*hx* denotes an X-axis driver, the reference numeral 56*hy* denotes a Y-axis driver, the reference numeral 55*hz* denotes a Z-axis driver, the reference numeral 37 denotes a control unit, the reference numeral 37*b* denotes a microcomputer, the reference numeral 37*b* denotes an external interface, the reference numeral 37*c* denotes a coating head controller, the reference numeral 37*d* denotes an image processing controller, the reference numeral 37*e* denotes a motor controller, the reference numeral 37*f* denotes a data communication bus, the reference numeral 38 denotes a USB memory, the reference numeral 39 denotes a hard disk drive, the reference numeral 40 denotes a monitor, the reference numeral 41 denotes a keyboard, the reference numeral 42 denotes a regulator.

In the drawing, the control unit 37 is composed of the microcomputer 37*a*, and the external interface 37*b*, the coating head controller 37*c*, the image processing controller 37*d*, and the motor controller 37*e* connected to the microcomputer 37*a* via the data communication bus 37*f*. The constituents of the control unit 37 are controlled under the management of the microcomputer 37*a*. Further, the USB memory 38 and the hard disk drive 39 as external memory devices of the microcomputer 37*a*, the monitor 40 as a data output section, and the keyboard 41 as an operating section are connected to the external interface 37*b*.

Further, the external interface 37*b* is connected to the air drive devices such as the suction section air cylinders 44*a*, the wind-off spindle motor 11, the wind-up spindle motor 12, and other motors for roll, and controls these components under the control of the microcomputer 37*a*. The external interface 37*b* is also connected to the vacuum pumps 59 acting as the vacuum source when vacuum sucking the film 1 with the suction bars 8, 9, and the suction table 10, and vacuum valve sections 60 for performing switching between these components, and controls these components under the control of the microcomputer 37*a*. Regarding the switching on/off of the pressurized air sources 61 and the valve unit 62, and switching on/off of the regulator 42 and the UV light source 50, the external interface 37*b* also controls these components under the control of the microcomputer 37*a*.

The coating head controller 37*c* controls whether or not the ejection of the coating material 65 (FIG. 12) from the ejection port of each of the nozzles of the coating head 15 is performed and the timing of the ejection under the instructions from the microcomputer 37*a*.

The image processing controller 37*d* is for taking the image of the geometry pattern and an alignment mark already provided to the film 1, and obtaining the position in the view field of the imaging camera 49 by image processing under the control of the microcomputer 37*a*.

The motor controller 37*e* controls drive of the X-axis drivers 54*hx* for driving the X-axis drive motors of the X-axis drive sections 54 (FIG. 11) attached with the coating heads 15 and the Z-axis drivers 55*hx* for driving the Z-axis drive motors of the Z-axis drive sections 55 (FIG. 11) under the control of the microcomputer 37*a*. Further, the motor controller 37*e* controls drive of the Y-axis driver 56*hy* for driving the linear motor or the drive motor of the Y-axis drive section 56.

The microcomputer 37*a* performs the moving control of the coating heads 15, which move integrally with the UV light sources 50, in the X-axis direction and the Y-axis direction via the motor controller 37*e*, and the microcomputer 37*a* has information about the current location and the following destination location of each of the UV light sources 50. Further, from the management of the operation sequence, the microcomputer 37*a* understands the timing of radiation and non-radiation by the UV light sources 50.

It should be noted that in the present embodiment, although the slidable UV shutter 52 and the suction section air cylinder 44*a* for driving the shutter and acting as the drive source thereof are disposed individually for each of the coating heads 15, it is also possible to dispose a pair of UV shutter 52 and the suction section air cylinder 44*a* for driving the shutter in common to the plurality of coating heads 15.

Figure 14:
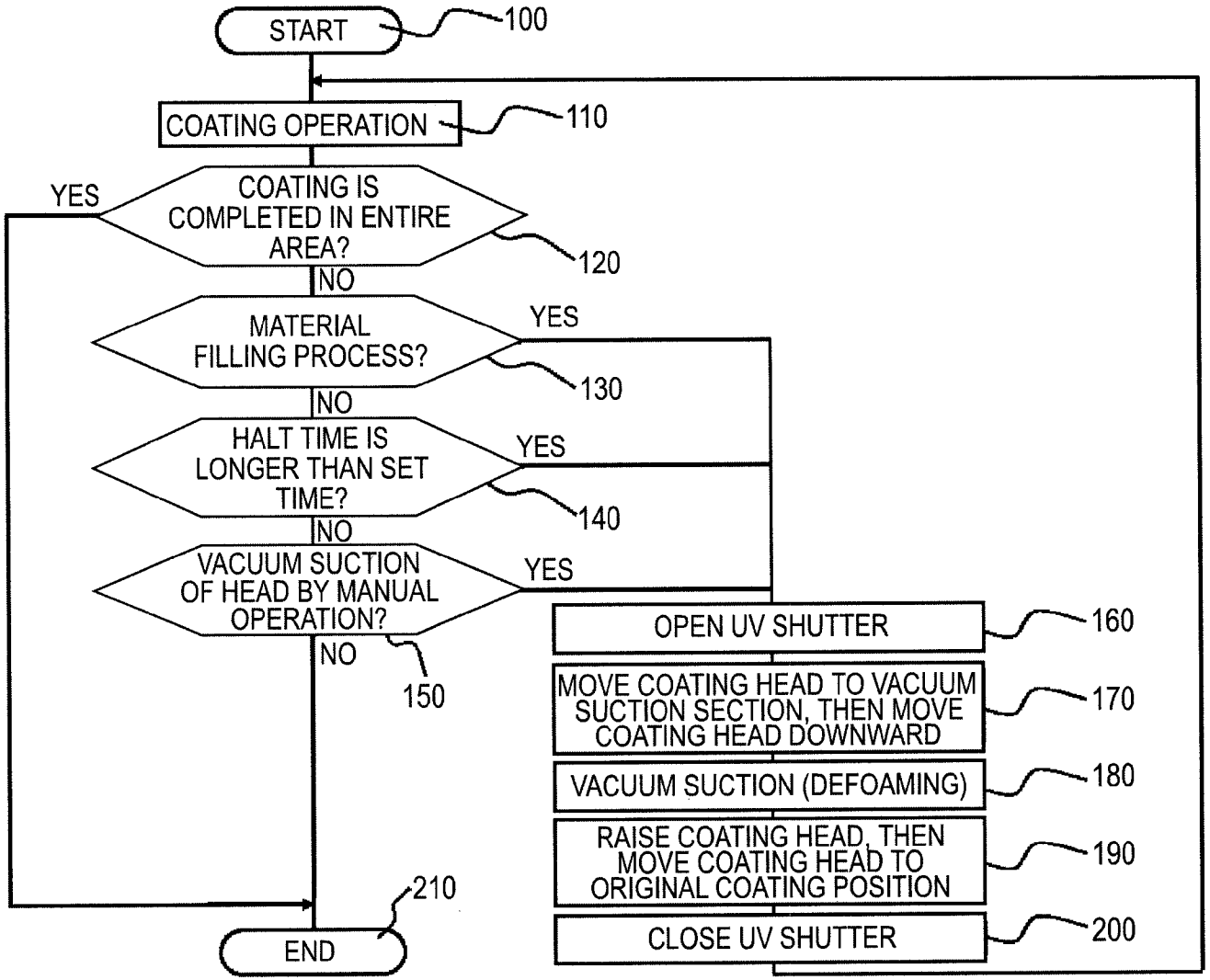
FIG. 14 is a flowchart showing a specific example of a vacuum suction operation of the vacuum suction section shown in FIG. 12.

The way of the operation of the UV shutter 52 is different in accordance with the ratio of the operation period representing whether the operation frequency of the vacuum suction of the coating heads 15.*by* the vacuum suction sections 43*a* is low or high. In the usage in which the vacuum suction of the coating heads 15 by the vacuum suction sections 43*a* is performed less frequently, the UV shutter 52 usually covers the upper part of the vacuum suction section 43*a* to thereby shield the inside of the vacuum suction section 43*a*, and the UV shutter 52 opens only at the necessary timing to set the suction port of the vacuum suction section 43*a* to the open state. A specific example of the vacuum suction operation will hereinafter be explained with reference to the flowchart shown in FIG. 14.

If the coating in the entire coating area has not been completed (steps 110, 120), there are three types of cases in which it is required to open the UV shutter 52 to perform the vacuum suction of the coating heads 15. Firstly, there can be cited the case ("Y" in the step 130) of filling each of the coating heads 15 with the material such as a UV-curing coating material. Secondly, there can be cited the case ("Y" in the step 140) in which the time during which each of the coating heads 15 stops at the same position exceeds a predetermined period of time. Thirdly, there can be cited the case ("Y" in the step 150) of performing the vacuum suction of the coating heads 15 manually. If none of the cases is true, the operation corresponding to the step 110, "N" in the step 120, "N" in the step 130, "N" in the step 140, and "N" in the step 150 is repeated to perform application of the UV-curing coating material, but not to perform the vacuum suction of the coating heads 15.

In the case in which either one of the three types of cases is true, firstly, the UV shutter 52 is moved to open (step 160) the suction port of the vacuum suction section 43*a*, thereby making the condition in which no optical shielding member exists above the suction port of the vacuum suction section 43*a*. Subsequently, the coating heads 15 are moved to the positions above the vacuum suction sections 43*a* by the X-axis drive sections 54 and the Y-axis drive sections 56 (FIG. 11), and then after confirming the completion of opening of the suction ports of the vacuum suction sections 43*a*, the coating heads 15 are moved downward (step 170) by the Z-axis drive sections 55 (FIG. 11). Subsequently, the vacuum suction is performed on the coating heads 15 pressed against the suction ports on the upper surfaces of the vacuum suction sections 43*a* through the ejection ports of the nozzles by driving the vacuum pumps 59 (FIG. 11), thereby defoaming (step 180) the inside of the coating heads 15. After terminating the defoaming process, the coating heads 15 are raised by the Z-axis drive sections 55 (FIG. 11), and then the coating heads 15 are moved (step 190) to the subsequent operation target positions on side of the suction table 10, respectively. Finally, after confirming that the coating heads 15 have been raised, the suction ports of the vacuum suction sections 43*a* is closed with the UV shutters 52, thereby optically shielding (step 200) the suction ports of the vacuum suction sections 43*a* so that the UV light 66 is not applied to the inside of the vacuum suction sections 43*a*.

On the other hand, in the usage in which the vacuum suction of the coating heads 15 by the vacuum suction sections 43*a* is performed frequently, if the coating head 15 forming a unit together with the UV light source 50 enters within a predetermined range L from the vacuum suction section 43*a*, the UV shutter 52 is slid to open the suction port of the vacuum suction section 43*a*. It is arranged that in order to optically shield the inside of the vacuum suction section 43*a*, if the coating head 15 is moved to the outside of the predetermined range from the vacuum suction section 43*a*, the operation of closing the UV shutter 52 is performed. Although open/close timing of the UV shutter 52 is different from the timing thereof in the steps 160 and 200 of FIG. 14, other individual operations are the same as those shown in FIG. 14.

Figure 15:
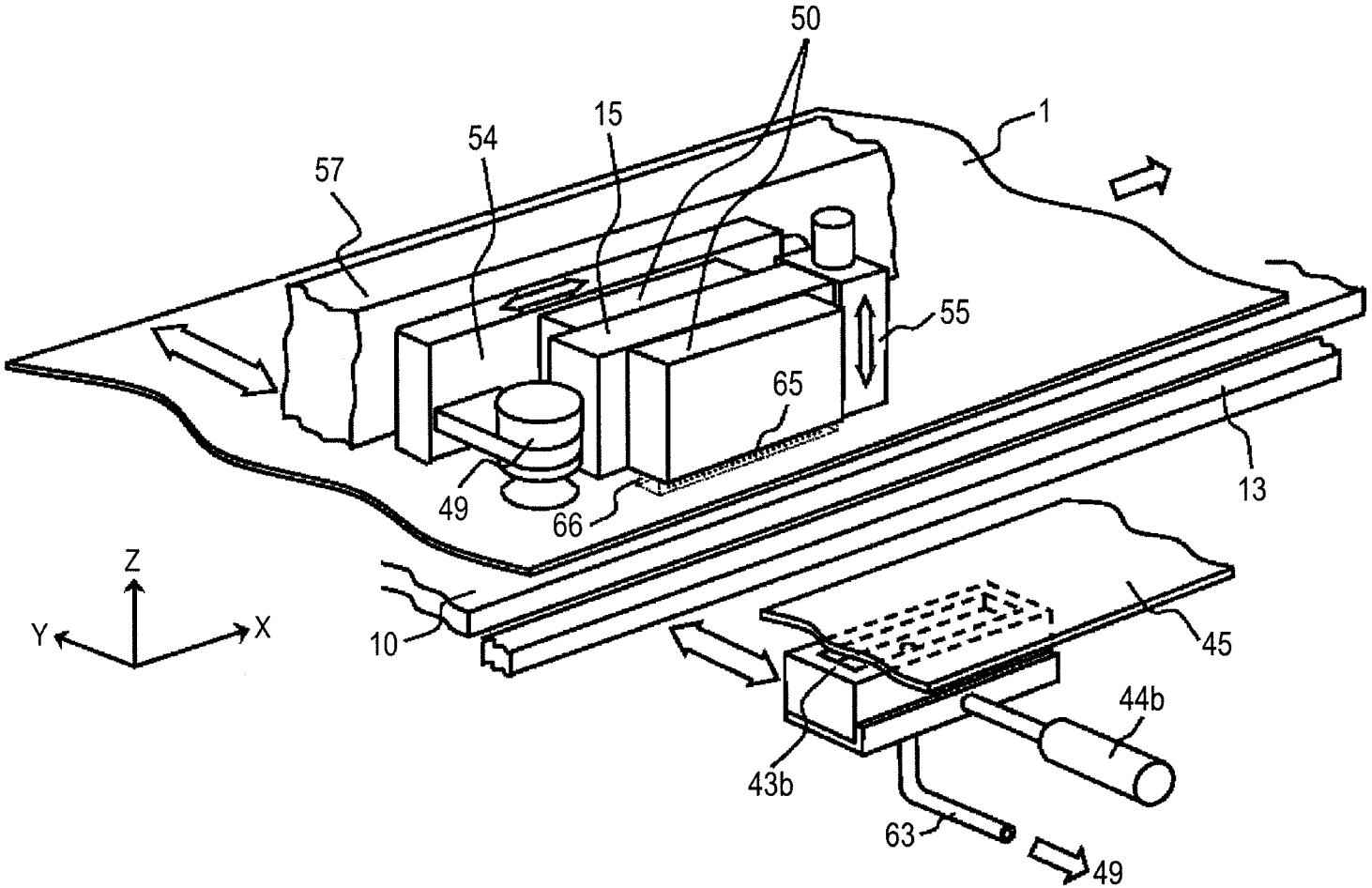
FIG. 15 is a perspective view showing a schematic configuration of a substantial part of an inkjet coating device and an inkjet coating method according to a sixth embodiment of the invention.

FIG. 15 is a perspective view showing a schematic configuration of a substantial part of an inkjet coating device and an inkjet coating method according to a sixth embodiment of the invention. The reference numeral 43*b* denotes the vacuum suction section, the reference numeral 44*b* denotes the suction section air cylinder for driving the vacuum suction section, the reference numeral 45 denotes a UV blocking plate, and the constituents corresponding to those shown in FIG. 12 are denoted by the same reference numerals, and the redundant explanation will be omitted.

Also in the sixth embodiment, the UV-curing coating material scattered in the vacuum suction section due to the suction of the inside of the coating head 15 for removing the bubbles inside the coating head 15 is prevented from being exposed to the UV light.

As shown in FIG. 15, in the sixth embodiment, it is arranged that the vacuum suction section 43*b* can be reciprocated (slid) in the Y-axis direction, which is the width direction of the film 1, by the suction section air cylinder 44*b* for driving the vacuum suction section. Further, the UV blocking plate 45 is disposed at a fixed position a predetermined distance distant from the suction table 10 in the Y-axis direction. The other part of the configuration is the same as that of the fifth embodiment shown in FIG. 12.

In such a configuration, when not in use in the normal operation, the vacuum suction section 43*b* is located under the UV blocking plate 45, and in the state in which the suction port is blocked by the UV blocking plate 45. If the suction in the coating head 15 is necessary, the vacuum suction section 43*b* is slid from the position under the UV blocking plate 45 and pushed out toward the film 1 by the suction section air cylinder 44*b*. Thus, the suction port on the upper surface of the vacuum suction section 43*b* becomes in the open state. By moving the coating head 15 to the vacuum suction section 43*b*, and pressing the coating head 15 against the suction port, the vacuum suction of the inside of the coating head 15 becomes possible. After terminating the vacuum, suction described above, the vacuum suction section 43*b* is slid in a direction apart from the suction table 10 and then retracted under the UV blocking plate 45 by the suction section air cylinder 44*b* for driving the suction section. Thus, the vacuum suction section 43*b* can become in the state in which the UV light 66 is blocked.

In such a manner as described above, similarly to the fifth embodiment, also in the sixth embodiment, the UV-curing coating material sucked inside the vacuum suction section 43*b* can be prevented from curing due to the irradiation of the vacuum suction section 43*b* with the UV light 66, and the coating of the film 1 with such a material can be performed with the coating head 15 in a good condition.

Here, it is arranged that the vacuum suction section 43*b* is reciprocated by the suction section air cylinder 44*b* for driving the vacuum suction section between a first position under the UV blocking plate 52*a* and a second position closer to the suction table 10 than the first position, and where the vacuum suction of the coating head 15 is possible. Further, it is also possible to arrange that the vacuum suction section 43*b* can be moved to a third position, which is further from the suction table 10 than the position under the UV blocking plate 45, if necessary (e.g., in accordance with an operation of an operator). In the third position, the vacuum suction section 43*b* is located outside the UV blocking plate 45, and the suction port of the vacuum suction section 43*b* becomes in the open state. However, since the suction port is far distant from the UV light sources 50 provided to the coating head 15, the suction port of the vacuum suction section 43*b* is never irradiated with the UV light 66 from the UV light source 50. Therefore, by positioning the vacuum suction section 43*b* at the third position, there is a little chance to receive the UV light 66, it becomes possible to clean the vacuum suction section 43*b* during the coating process in a working state, and therefore, a stable coating process can be realized without degrading the manufacturing takt time.

As described above, according to each of the embodiments, the curl correction can be performed on the film 1 in the coating section 17 so that the film 1 can be held by vacuum sucking, and the film 1 is vacuum sucked on the suction table 10 stably and with high accuracy, thereby making it possible to apply the coating material to the surface of the film 1 with good accuracy.

Further, since it is possible to confirm whether or not the curl correction has been performed surely, coating can be performed stably.

Further, by using the light blocking section in the vacuum suction section 43*a* when applying the UV-curing coating material, it becomes extremely difficult for the scattered UV-curing coating material to be exposed to the UV light 66, and therefore, the inside of the vacuum suction section 43*a* is prevented from being blocked, and the stable coating operation can be maintained.

What is claimed is:

1. An inkjet coating device comprising:

an upstream guide roller adapted to wind off and then convey a rolled film, the rolled film having a longitudinal direction corresponding to an X-axis direction, and the rolled film having a width direction corresponding to a Y-axis direction;

a suction table adapted to hold by sucking the film thus wound off;

an inkjet coating head adapted to apply a liquid UV-curing coating material to a surface of the film thus held by sucking on the suction table;

a gantry structure adapted to allow the coating head to move above the film in a plane defined by an X axis and an Y axis;

a Z-axis drive section adapted to allow the coating head to move vertically; an ultraviolet light source capable of moving integrally with the coating head in X, Y, and z axis directions;

a downstream guide roller adapted to wind up the film to form a roll;

a vacuum suction section located at a position outside a film conveying range, having a suction port having contact with the coating head when the coating head moves to the position and then moves downward, and adapted to suck nozzles of the coating head through the suction port, the vacuum suction section configured to be reciprocated in the Y-axis direction of the film; and a light blocking section adapted to block incidence of ultraviolet light from the ultraviolet light source to the inside of the vacuum suction section, wherein block of the ultraviolet light and release of the block can be selected by reciprocating the vacuum suction section in the Y-axis direction relative to the light blocking section, and wherein the light blocking section is disposed at a fixed position a predetermined distance from the suction table in the Y-axis direction.

2. The inkjet coating device according to claim 1, wherein the light blocking section is reciprocated by a linear drive section between an upper surface position of the vacuum suction section and a position shifted from the upper surface position in a shutter-like manner.

3. The inkjet coating device according to claim 2, further comprising a microcomputer configured to perform moving control of the coating head.

4. The inkjet coating device according to claim 3, wherein the microcomputer is further configured to perform moving control of the coating head such that the vacuum suction section, normally, has the light blocking section adapted to block incidence of the ultraviolet light, obtains current position information of the coating head, and releases the block of the incidence of the ultraviolet light by the light blocking section when a distance between the coating head and the vacuum suction section comes into a predetermined range.

5. The inkjet coating device according to claim 1, wherein the downstream guide roller is further adapted to convey the film provided with the coating material.

6. The inkjet coating device according to claim 5, further comprising a microcomputer configured to perform moving control of the coating head.

7. The inkjet coating device according to claim 1, further comprising a microcomputer configured to perform moving control of the coating head.

8. The inkjet coating device according to claim 7, wherein the microcomputer is further configured to perform moving control of the coating head such that the vacuum suction section, normally, has the light blocking section adapted to block incidence of the ultraviolet light, obtains current position information of the coating head, and releases the block of the incidence of the ultraviolet light by the light blocking section when a distance between the coating head and the vacuum suction section comes into a predetermined range.

* * * * *